US006974096B2

(12) United States Patent
Van Der Zanden

(10) Patent No.: US 6,974,096 B2
(45) Date of Patent: Dec. 13, 2005

(54) MILL WITH STREAMLINED SPACE

(75) Inventor: Johannes Petrus Andreas Josephus Van Der Zanden, Ring of Kerry, Dunkilla, Tahilla, Co. Kerry (IE)

(73) Assignees: Johannes Petrus Andreas Josephus Van Der Zanden, Co. Kerry (IE); Rosemarie Johanna Van Der Zanden, Co. Kerry (IE); IHC Holland N.V., Kinderdijk (NL)

( * ) Notice: Subject to any disclaimer, the term of this patent is extended or adjusted under 35 U.S.C. 154(b) by 348 days.

(21) Appl. No.: 10/149,295

(22) PCT Filed: Jun. 27, 2001

(86) PCT No.: PCT/NL01/00482

§ 371 (c)(1),
(2), (4) Date: Jun. 11, 2002

(87) PCT Pub. No.: WO02/07887

PCT Pub. Date: Jan. 31, 2002

(65) Prior Publication Data

US 2002/0179754 A1 Dec. 5, 2002

(51) Int. Cl.[7] ..... B02C 19/00
(52) U.S. Cl. ..... 241/5; 241/275
(58) Field of Search ..... 241/5, 275

(56) References Cited

U.S. PATENT DOCUMENTS 2,357,843 A 9/1944 Morrissey
5,863,006 A 1/1999 Thrasher

FOREIGN PATENT DOCUMENTS

| | | |
|---|---|---|
| DE | 90 15 362 U | 1/1991 |
| EP | 04100551 | 4/1992 |
| EP | 0 835 690 A1 | 4/1998 |
| WO | WO 96/32197 | 10/1996 |

*Primary Examiner*—Mark Rosenbaum
(74) *Attorney, Agent, or Firm*—Young & Thompson

(57) ABSTRACT

The method and the device relate to a rotor which rotates about a vertical axis and is fitted in a streamlined mill in which the stationary collision surface is constructed as a smooth (cylindrical) collision ring and is arranged an adequate distance away from the rotor and thus makes it possible to allow the material to collide, optionally several times, in an essentially completely deterministic manner, or at an essentially predetermined collision location, at an essentially predetermined collision velocity and at an essentially predetermined collision angle; by which a high probability of breakage—and thus the degree of comminution—is achieved, the energy consumption is reduced, wear is restricted and a crushed product is produced which has a regular grain size distribution, a restricted amount of undersize and oversize and a very good cubic grain configuration, the effect—i.e. the determinism—essentially not being influenced by the wear on the collision element, while the material does not rebound (or at least rebounds to a much lesser extent) against the rotor.

37 Claims, 24 Drawing Sheets

MILL WITH STREAMLINED SPACE

FIELD OF THE INVENTION

The invention relates to the field of the acceleration of material, in particular a stream of granular or particulate material, with the aid of centrifugal force, with, in particular, the aim of causing the accelerated grains or particles to collide at such a velocity that they break.

According to a known technique material can be crushed by exerting impulse loading thereon. Such impulse loading is produced by allowing the material to collide with a wall at high velocity so that it breaks. In order to achieve as high as possible a probability of breakage it is of essential importance that the collision takes place as far as possible free from Interference. The angle at which the material impinges on the armoured ring also has an influence on the probability of breakage; and the same applies to the number of impacts the material makes or has to cope with; and how quickly these impacts follow one another.

Generation of the movement of the material—usually a stream of grains—frequently takes place under the influence of centrifugal forces with this technique the material is accelerated with the aid of movement members and propelled outwards front a rapidly rotating rotor as a stream (bundle) at high take-off velocity and at a certain take-off angle, in order then to collide at high impact velocity with an armoured ring positioned around the rotor. The impulse forces generated during this operation are directly related to the take-off velocity at which the material leaves the rotor; in other words, the faster the rotor turns in a specific set-up the greater is the collision velocity and usually the better is the crushing result.

The collision velocity is determined by the take-off velocity and the angle of impact ($\beta$) by the take-off angle ($\alpha$) (and, of course, the angle at which the impact surface is arranged). The take-off velocity is determined by the rotational velocity of the rotor and is made up of It radial velocity component and a velocity component oriented perpendicularly to the radial component, i.e. a transverse velocity component, the magnitudes of which are determined by the length, shape and positioning of the acceleration member and the coefficient of friction, The take-off angle ($\alpha$) is essentially determined by the magnitudes of radial and transverse velocity components and is usually barely affected by the rotational velocity. If the radial and transverse velocity components are identical, the take-off angle ($\alpha$) is 45°; if the radial velocity component is greater the take-off angle ($\alpha$) increases and if the transverse velocity component is greater the take-off angle ($\alpha$) decreases.

Viewed from the stationary standpoint—i.e. in absolute terms—the material moves at virtually constant absolute velocity along a virtually straight stream after it leaves, the acceleration member, which stream is directed outwards and forwards, viewed from the axis of rotation, viewed in the plane of rotation and viewed in the direction of rotation.

Viewed from a standpoint moving with the guide member—i.e. in relative terms—the material moves in a spiral stream after it leaves the acceleration member, which spiral stream is oriented outwards and backwards and is in the extension of the movement of the material along the acceleration member, viewed from the axis of rotation, viewed in the plane of rotation and viewed the direction of rotation. As far as its location is concerned, the spiral stream is not affected by the rotational velocity and is therefore invariant. During this operation the relative velocity increases progressively along said spiral stream as the material moves further away from the axis of rotation.

The material propelled outwards can be collected by a stationary collision member that is arranged transversely in the straight stream which the material describes, with the aim of causing the material to break during the collision. The comminution process takes place during this single collision, in which context there is said to be a single impact crusher.

Research has shown that for the majority of materials a vertical impact is not optimum for comminution of material by means of impact loading and that, depending on the specific type of material, a (much) higher probability of breakage can be achieved with an impact angle of approximately 70°, or at least between 60° and 80°. Below 65° to 60° the probability of breakage starts to decrease progressively because the impact angle is too shallow and a glancing blow starts to develop. Wear increases as a result. Furthermore, the probability of breakage can also be appreciably increased if the material for crushing is subjected not to single but to multiple, or at least double, impact loading occurring rapidly in succession.

Such a multiple impact can be achieved by, instead of allowing the material to strike a stationary collision member directly, first allowing the material to strike an impact member that is co-rotating with a movement member, the impact surface of which impact member is arranged transversely in the spiral stream which the material describes. The material is simultaneously loaded and accelerated during the co-rotating impact, after which it is propelled outwards from the rotor and strikes, for a second time, a stationary collision member that is arranged around said rotor. With this arrangement there is said to be a direct multiple impact crusher. In this context it is possible to allow the material to strike at least one further co-rotating impact member before it collides with the stationary collision member, by which means a direct threefold—or even more—impact can be achieved It is thus possible using known techniques to bring material into motion with the aid of centrifugal force and then to subject it to single or multiple loading in various ways The influence which multiple impact and the angle of impact has on the probability of breakage has been investigated in detail by Brauer (Ruppel, P., Brauer, H: Comminution of single particles by repetitive impingement on solid surfaces, 1st World Congress Particle Technology, Nümberg, 16–18 Apr. 1986). The relative and absolute movement of the material in a rotating system has been discussed in detail in U.S. Pat. No. 5,860,605 in the name of the Applicant.

BACKGROUND TO THE INVENTION

The invention described here relates to a mill having a stationary collision member that is arranged around a rotor that rotates about a vertical axis of rotation, by means of which material, in particular a stream (bundle) of granular materials is accelerated with the aid of an acceleration unit and propelled outwards from said rotor with, in particular, the aim of allowing the material to collide in an essentially deterministic manner—or at an essentially predetermined collision location, at an essentially predetermined collision angle and at an essentially predetermined collision velocity with said collision member, said material being loaded in such a way that it breaks or is comminuted in a manner that (as far as possible) is predetermined—i.e. (as far as possible) is deterministic; the determinism essentially not being affected by the wear which takes place on said collision member.

For the invention described here it is important to establish that—under the conditions described here—it is essentially physically impossible to propel material outwards from a rotor with only a radial (or only a transverse) velocity component. Under normal conditions the take-off angle is between 25° and 50°. It is therefore physically also impossible—under the conditions described here—to propel material outwards from a rotor along a straight radial stream (absolute take-off angle $\alpha$=90°), viewed from a stationary standpoint; as is often (instinctively) suggested, including in the patent literature. The movement that material makes when it is accelerated in a rotating system—or under the influence of centrifugal force—is frequently incorrectly, or physically inaccurately, described The reason for this is that it is apparently difficult to imagine such a movement; which movement can (must) be regarded from a Stationary find a co-rotating standpoint at the same time. Instinctively one rapidly reaches an incorrect interpretation, A typical example of such a (physically inaccurate) conception of the state of affairs can be found in DE 39 26 203 A1 (Trapp) which describes movement of grains of the material from the central section of a rotor towards the outer edge of said rotor, which movement of grams actually takes place in the reverse direction. In the known single impact crushers the material is accelerated with the aid of acceleration members, which are carried by a rotor and are provided with radially (or forwards or backwards) oriented acceleration surfaces and propelled outwards at high velocity—under a take-off angle of 35° to 40°—against a stationary collision member in the form of an armoured ring made up of anvil elements, which is arranged around the rotor a relatively short distance away. The collision surfaces of the stationary collision member are generally so arranged that the collision with said stationary collision member as far as possible takes place perpendicularly. The consequence of the specific arrangement of the Collision surfaces of the individual anvil elements—at an angle—which is necessary for this is that the armoured ring as a whole has a type of knurled shape with projecting comers. Such a device is disclosed in U.S. Pat. No. 5,921,484 (Smith, J, et al.).

The collision surfaces of the individual anvil elements of the known single impact crushers are often straight in the horizontal plane, but can also be coed, for example in accordance with an evolvent of a circle. Such a device is disclosed in U.S. Pat. No. 2,844,331. What is achieved by this means is that the impacts all take place at the same (perpendicular) angle of impact. U.S. Pat. No. 3,474,974 discloses a device for a single impact crusher in which the stationary impact surfaces are oriented obliquely downwards in the vertical plane, as a result of which the material rebounds downwards after impact. What is achieved in this way is that the angle of impact is more optimum, the impact of subsequent grains is less disturbed by breakage fragments from previous Impacts and the breakage fragments do not rebound against the edge of the rotor.

U.S. Pat. No. 5,860,605, in the name of the Applicant, discloses a method and device for a direct multiple impact crusher (SynchroCrusher) which is equipped with a rotor which rotates about a vertical axis of rotation, by means of which the material is accelerated in two steps, i.e. guiding along a relatively short guide member and, respectively, an (entirely deterministic) blow by a co-rotating impact member, in order then to allow it to collide with a stationary collision member, for example in the form of individual evolvent collision elements (with projecting Joints) which are arranged around the rotor and which have the effect of causing the material to strike perpendicularly. Loading takes place in two immediately successive (synchronised) steps. The second collision takes place at a velocity, or kinetic energy, which remains after the first impact; that is to say without additional energy having to be added. Said residual velocity is usually at least equal to the velocity at which the first impact takes place.

U.S. Pat. No. 2,357,843 (Morrissey) discloses an impact crusher with which a Stationary collision member is arranged around the rotor a short distance away, the collision surface of which collision member is cylindrical; here it is suggested that the material is propelled radially outwards from the rotor, which, as has already been explained, is physically impossible (inaccurate) under the indicated conditions because, in addition to a radial velocity component, the material also builds up an appreciable (usually even greater) transverse component along the guide member.

PCT/WO 94/29027, in the name of the Applicant, discloses an impact crusher with which the material is propelled from the rotor against the inside of a first stationary conical ring that widens towards the bottom and is arranged around the rotor, a short distance away, the intention being that the material strikes the collision ring in a virtually radial direction and then rebounds obliquely downwards in a virtually radial direction against the outside of a second stationary conical ring that widens towards the bottom and is arranged below the rotor, after which the material continues to move downwards in a zig-zag bouncing movement through the slit-shaped gap between the conical rings in the virtually vertical direction. The distance between the two collision surfaces can be adjusted to some extant in that the height of the outer ring is adjustable. It is suggested that the material is propelled outwards from the rotor, which is equipped with guides curved severely backwards, in a virtually radial directions with the aim of impinging virtually perpendicularly (radially) on the first stationary conical ring, viewed from the plane of rotation The optimum angle of impact of approximately 70° is obtained with the aid of the conical shape of the Collision surface. As already indicated, it is, however, physically impossible to propel the material outwards from the rotor in this way in a radial direction (take-off angle a of approximately 90°), with such an arrangement of the guide and collision element the take-off angle ($\alpha$), and thus the angle of impact, is actually much smaller (approximately 45°) and during impact on the conical ring there can essentially be said to be a glancing blow, the material being subjected to only limited loading and continuing to rebound in the plane of rotation; and starts to describe a glancing circular (spiral) movement oriented obliquely downwards in the slit-shaped gap.

G 90 15 362.6 (Gebrauchsmuster DE-Pfeiffer) discloses an impact crusher with which a stationary collision member is arranged around the rotor, which collision member is so constructed that the distance between the outer edge of the rotor and the collision surface is adjustable.

JP 4-100551 (Kuwabara Tadao et al.) discloses an impact crusher equipped with a rotor around which a stationary collision member is arranged in the form of an armoured ring made up of so-called anvil blocks, each of which is equipped with an impact surface that is oriented perpendicularly to the path that the material describes when it is propelled outwards from the rotor. The armoured ring as a whole consequently has a knurled shape with projecting comers. In the known impact crusher the radial distance (L) between the projecting points of the anvil blocks and the outer edge of the rotor is chosen so large that, on the one hand, as little material as possible rebounds against the outer edge of the rotor after the collision, so that wear at this edge is restricted, and, on the other hand, a good degree of comminution is nevertheless obtained. On the basis of an investigation that was carried out, the data of which are incorporated in JP 4-100551, the length L was determined as 250–350 mm for a circumferential velocity of the rotor of 50–70 m/sec. The diameter of the rotor, the diameter of the armoured ring and the take-off angle ($\alpha$) were not taken into account in the investigation.

U.S. Pat. No. 5,863,006 (Thrasher, A) discloses an autogenous impact crusher that is equipped with a rotor by means of which the material is, as it were, autogenously accelerated, as a result of which wear is restricted. The autogenous rotor does, however, easily become unbalanced and is therefore equipped with an auto-balancing system in the form of a flat hollow ring that is arranged around the top edge of the rotor and is filled with oil and steel balls. This auto-balancing system has already been known for a long time (since 1880 from U.S. Pat. No. 229,787, Whitee). Recent publications relate to Julia Marshall: Smooth grinding (Evolution, business and technology magazine, SKF, No, 2/1994, pp. 6–7) and Auto-Balancing by SKF (publication 4597 E, 1997–03).

U.S. Pat. No. 4,389,022 (Burk) discloses a single impact crusher that is equipped with an annular collision member in the form of a sort of polygon with regular offsets, the individual line sections forming straight impact surfaces, the distance of which from the axis of rotation is alternately offset, as a result of which a sort of knurled polygon edge is formed. The collision surfaces of the line sections are arranged directly around the rotor and, when these wear, can be moved forwards, that is towards the axis of rotation.

In 1999 Nordberg marketed a single impact crusher that is equipped with a rotor which rotates about a vertical axis (Nordberg VI series, brochure number 0775-04-00-CED/Macon/English, 2000), the stationary impact member being constituted by an annular armoured member that is arranged around said rotor a relatively short distance away, which armoured member is made up of hollow cylinders which are positioned some distance apart alongside one another in a circular shape, each of which cylinders can be rotated (is adjustable) about its cylinder axis that runs parallel to the axis of rotation of the rotor. The stationary impact surface consequently does not have a knurled shape but has the shape of a number of segments in the form of an are arranged alongside one another in a circle. This has the advantage that the cylinders can be turned, so that the (entire) wear surface can be consumed. However, the impacts take place highly irregularly because the grains strike said are segments at highly divergent angles—from perpendicular to glancing blow—whilst some of the impacts can be disturbed or damped by the material itself that can settle between the are segments.

SUMMARY OF THE INVENTION

As already described, the known impact crushes have a number of advantages. For instance, impact loading is more efficient than pressure loading, inter alia because it yields a crushed product that has a more cubic shape. Furthermore, the construction is simple and small but also relatively large quantities of granular material with dimensions ranging from less than 0.1 mm to more than 100 mm can be processed. Because of the simplicity, the impact crushers are not expensive to purchase. In particular, the known direct multiple impact crushers has a high comminution intensity: at least twice as high as that of the known single impact crusher for, incidentally, the same energy consumption.

In addition to these advantages, the known impact crushers are also found to have disadvantages. For instance, the collision of the material stream on the stationary armoured ring is highly disturbed by the edges of the projecting corners of the armoured ring elements. This interference effect is fairly large and can be indicated as the length that is calculated by multiplying twice the diameter of the material to be crushed by the number of projecting corners of the armoured ring compared with the total length, i.e. the circumference, of the armoured ring: thus, it can be calculated that in the known single impact crushers more than half of the gains in the stream of material are subjected to an interference effect during impact. Moreover, the interference effect increases substantially as the extent to which the projecting, corners become rounded under the influence of wear increases, which usually takes place fairly rapidly; as a result of which the beneficial effect of constructing the impact surfaces such that they are oriented obliquely forwards and are curved is also rapidly eliminated, In the known direct multiple impact crusher the first collision against the moving impact member takes place without interference and entirely deterministically. The second impact, however, takes place against a (knurled) armoured ring, as a result of which the determinism is disrupted again by the projecting points. As the projecting points wear (and this usually takes place rapidly) a channel-shaped smooth ring is increasingly produced, as a result of which the angle of impact decreases substantially (from approximately 90° to approximately 45°) and a process of glancing blows starts to develop. The armoured zing is then no longer effective and has to be replaced; usually long before it has completely worn away.

Said interference effects have a substantial influence on the probability of breakage, and thus on the efficiency of the crusher, which decreases substantially as the interference effect increases. A great deal of the energy supplied to the material is converted into heat, which is at the cost of the energy available for crushing. A further disadvantage is the fairly substantial wear to which the known impact crushers are exposed. This applies in particular to the known single impact crushers which have a low efficiency. In order to achieve a reasonable degree of comminution the collision velocity usually therefore has to be increased as the projecting points begin to wear, which demands additional energy, causes wear, and Thus the said interference effect, to increase even more substantially, whilst an undesirably high number of very fine (undersize) and coarse (oversize) particles can be formed. The consequence of these various aspects is that the comminution process is not always equally well controllable, as a result of Which not all particles can be crushed in a uniform manner and too much undersize and oversize is produced. The crushed product obtained consequently frequently has a fairly wide spread in grain size and grain configuration.

Another disadvantage of the known impact crushers is the air resistance that is caused by the rotor. Specifically, in addition to material, a large amount of air is brought into motion by the rotor. A vacuum is created in the central section of a rotating rotor) in the gap between the start points of the movement members where the material is fed to the rotor, as a result of which additional air is drawn in here which, together with the air that is fed into the crusher housing with the stream of material, is accelerated together with said material. The material is essentially propelled outwards from the rotor in a powerful air stream (air streams).

As a result of the air movements that are generated by the rotor, a layer or bed of air is brought into a co-rotating movement in a region around the rotor, or between the outer edge of the rotor and the stationary collision member. The movement of the bed of ail is substantially disturbed or hindered by the projecting comers of the knurled stationary armored ring; and by other surfaces in the crushing chamber which are in a region close to the rotor, including the lid of the crusher housing, which in the known impact crushers is frequently of flat construction and located just above the rotor. The co-rotating bed of air as it were continuously chatters against the projecting points of the armoured ring and as a result is brought into a type of wave movement (which can be detected well with the aid of high-speed video recordings).

Furthermore, in the known impact crushers the shaft that bears the rotor is often laterally supported against the crusher housing. Such a support construction hinders the movement of the air stream through the crashing chamber in the region below the rotor. Material also accumulates on the pulley case, which further hinders the movement of the air stream, Thee air resistances result in a great deal of energy being lost. A substantial proportion of the energy consumption when idling is due to air resistance; and can easily be determined. With known impact crushers it is often found that the rotor accounts for a third to more than half of the energy consumption.

Furthermore, as a result of these interferences, the air stream starts to move through the crushing chamber in an essentially stochastic manner; with the result that the grains, that are carried along by the air stream, also start to move in a stochastic manner. As a result, both the direction of The movement and the way in which (angle and velocity at which) the grains collide with the stationary collision member is difficult to predict or actually unpredictable. The stochastic manner of impact is the reason why the load on the individual grains during the impact proceeds highly indeterministically, as a result of which a substantial proportion of the (movement) energy that is supplied to the grains is lost; or at least is not efficiently converted from kinetic energy into potential energy. The stochastic nature of the movement of the grains also results in a great deal of additional wear occurring, on both the armoured ring, the rotor (especially on the outside) and other surfaces in the crushing chamber; whilst as a result of the abrasive action Additional (excess) fine particles can be produced. Moreover, it is difficult to make the air stream—and thus the dust problems—controllable. A further consequence of the stochastic movement of the air stream is that an appreciable amount of kinetic energy which the material still possesses when it rebounds against the stationary armoured ring after impact cannot be utilised effectively and is lost.

AIM OF THE INVENTION

The aim of the invention is therefore to provide an impact crusher, as described above, which does not have these disadvantages or at least displays these disadvantages to a lesser extent. Said aim is achieved by a method and a device for causing material to collide at least once, in an essentially deterministic manner, for loading said material, in such a way that said material is comminuted in an essentially predetermined manner, with the aid of at least one collision member; for which reference is made to the claims.

The method of the invention mikes use of the fact that the direction of movement of the material—in the ostensible or apparent sense—changes. Specifically, when the material is propelled outwards from the rotor at a take-off location said material moves along a straight ejection stream oriented obliquely forwards, the direction of which in the apparent sense moves increasingly in the radial direction as the grains become further removed from the axis of rotation; however, the direction is, of course, never entirely radial, viewed from the axis of rotation and viewed from a stationary standpoint.

The consequence of this is that when an annular collision surface is arranged concentrically around the rotor, which collision surface is supported by said crusher housing and acts as a stationary collision member, the collision angle is constant for all grains and the magnitude of the collision angle increases as the free radial distance between the rotor and the annular collision surface increases, It is therefore possible to allow all grains from the stream of material to collide on the collision surface of the annular collision element in an essentially identical manner under a predetermined optimum collision angle, completely free from interference or in a completely deterministic manner. For the majority of materials the optimum collision angle is greater than or equal to 70°. The magnitude of the free radial distance between the rotor (or mol e accurately take-off location at which the material leaves the rotor) and the annular collision surface, required to achieve such an optimum collision angle, is determined by the take-off angle ($\alpha$) and can be calculated as.

$$\frac{r_2}{r_1} \geq \frac{\cos\alpha}{\cos\left(\frac{\beta}{180}\pi\right)}$$

In the case of a multiple impact crusher the take-off angle is 45° to 50°. For a collision angle of 70° the free radial distance must then be approximately equal to the rotor diameter, In the case of a single impact crusher the take-off angle is normally shallower, 35° to 40°. The free radial distance must then be chosen appreciably greater, which leads to a crusher Housing of a large diameter, Thus, both types of crusher can be combined with an annular collision surface, but the multiple impact crusher is to be preferred.

The take-off location is the location at which the accelerated material leaves the rotor and is propelled outwards, Depending on the rotor construction, the take-off location is determined by the outer edge of the guide member in the case of a single impact crusher. However, if the guide surface is curved, the material can leave this guide surface before it has reached the outer edge. In the case of a multiple impact crusher the material is propelled outwards from the rotor (from the co-rotating impact member). Depending on the angle at which the material impinges on the co-rotating impact surface and the angle at which the co-rotating impact surface is arranged, the material can leave said co-rotating impact surface at the location where it impinges and thus rebounds immediately, however, The material can also be retained by the co-rotating impact surface after impingement and still execute a guiding movement along the co-rotating impact surface. The material can then leave at the location of the outer edge of the co-rotating impact surface or from a location between the co-rotating impact location and the outer edge. The outer edge of the acceleration member or the co-rotating impact member is often coincident with the outer edge of the rotor. The takeoff location can therefore be defined in several ways, but can be calculated fairly exactly and is thus predetermined.

For the record, the annular collision surface, as specified in the invention, is defined here as, respectively, an annular collision member that does not have a projecting collision relief on its inner circumference, a smooth (metal) collision surface in the form of an annular collision member, for example a stator, cylinder wall or cone, a composite collision surface in the form of a regular polygon, a discontinuous collision surface that is provided with openings, preferably in the form of vertical joints or slits that are regular distances apart, in which openings the material itself is able to settle, in such a way that some of the impacts take place against metal and some against the material itself, and an annular collision surface that is formed entirely of a bed of its own crushed material that settles in an open annular channel construction that is arranged centrally around the rotor with the opening facing inwards.

The material is defined as fragments, grains or particles, the dimensions of which call range from less than 0.1 mm to more than 250 mm of rock-like material, ores, minerals, glass, slags, coal, cement clinker and the like, and other types of materials, such as plastic, nuts, coffee/cocoa beans, flour and the like.

In addition to the said deterministic optimum impact, a smooth annular collision surface of the collision member that is arranged an adequate radial distance away from the rotor also has the advantage that the movement of air along the impact surface (or in the gap between the rotor and the annular collision surface) is not impeded, as a result of which the rebound also takes place in a deterministic manner; with this arrangement the rebound movement takes place in a tangential direction, the material being entrained by the stream of air that is circulating through the crusher space. Rebounding of the grams against the outside of the rotor is therefore virtually precluded; or at least is substantially reduced.

In this context it is possible to construct the annular collision surface as a cylinder wall or also as a (truncated) cone widening towards the bottom; what is achieved by this means being that the grains rebound directed somewhat more downwards after the impact. The annular collision member can be constructed in one piece or also in segments; and it is also possible to place a number of rings on top of one another.

The invention furthermore provides the possibility of making the space above the rotor conical or at least of leaving a large gap between the rotor and the lid, as a result of which the air resistance between the rotor and the lid of the crusher housing is also restricted to a minimum.

The device according to the invention furthermore provides the possibility for making the space below the rotor to the outlet completely open, or streamlined which is achieved by supporting the shaft only at the bottom, for example on the pulley case, this pulley case preferably being continued in one direction and, moreover, the space between the V-belts being made open in the form of a tube. What is achieved in this way is that no material giving rise to air resistance is able to accumulate in the crushing chamber.

This open construction below the rotor furthermore makes it possible to allow a conical autogenous bed (narrowing towards the bottom) of the material itself to build up all round on the bottom of the smooth collision ring. In addition to protecting the outer wall, this also provides the possibility for optimum (complete) utilisation of the appreciable amount of residual energy (residual velocity) which the material still possesses when it leaves the smooth ring after the collision. As has been stated, this is because the material is then entrained immediately by the stream of air and further guided in a tangential direction; with a velocity that is approximately 50%–75% of the velocity at which it collides with the collision ring (which has been established using high-speed video recordings). The circulating stream of air furthermore ensures that a vortex develops which moves downwards all round along the autogenous conical bed, this stream of air being further accelerated. The material is drawn into this vortex with the stream of air and describes a fairly long corrasive movement (of up to a few revolutions) along the autogenous bed at high velocity. This corrasive after-treatment is fairly intensive and has the effect of rendering the crushed material more cubic.

In this context it is important that as the free radial distance between rotor (or the take-off location from which the material flies off the rotor) and the annular collision surface increases, the rebound angle also increases with the collision angle; together with the greater radius, a greater rebound angle has the effect that the movement path along which the material moves when it rebounds describes a progressively longer chord within the circular collision Surface. This has the advantage that the wear along the collision surface is restricted and makes it possible better to guide the material in a vortex to the autogenous bed below the annular collision member.

The crushing process thus takes place in three phases:

primary impact against the co-rotating impact member which takes place completely deterministically at an impact velocity that can be accurately controlled by means of the rotational velocity of the rotor;

secondary collision with the stationary collision member which takes place completely deterministically at a collision velocity that is at least equal to the impact velocity;

the deterministic nature (in particular the angle of impact and the collision angle) of the primary and secondary impacts not being essentially influenced by wear oil, respectively, the co-rotating impact member and the smooth ring, tertiary corrasive after-treatment at a velocity that is approximately 50%–75% of the collision velocity which further increases along the vortex.

Energy is supplied to the material only for the pry impact. The secondary collision and the tertiary corrasive after-treatment take place entirely with the residual energy which results after the primary impact. Furthermore, the rebound velocity after the co-rotating impact on the one hand is determined by the elasticity of the collision partners (material and impact surface) and on the other hand can be substantially influenced by allowing the material still to move outwards along said impact surface after the impact, the material being further accelerated under the influence of centrifugal force (which is highly effective at said radial distance). The latter take s place when the impact surface extends from the impact location towards the outer edge of the rotor; and this extending portion is not oriented too far backwards. The various features do, however, result in (a large amount of) guide wear.

A crusher constructed with a rotor with a co-rotating impact member and an annular collision member consequently has an extremely high comminution intensity (the amount of new surface that is produced per unit energy supplied from outside for a specific mass of material) and the same applies with regard to the comminution effectiveness (the ability to achieve the desired degree of comminution, configuration and selection) and as far as this is concerned is superior to all existing types of crusher.

Finally, the annular collision member makes it possible to allow the material, when it rebounds from the annular collision surface, to impinge again (in an entirely deterministic manner) on an impingement member co-rotating with the rotor, the impact surface of which impingement member is arranged transversely in the spiral path which the material then describes, viewed from a standpoint co-rotating with said impingement member.

The method and device according to the invention also provides a possibility for controlling the height, or the location of the top edge of the conical autogenous bed, or making this adjustable. This takes place with the aid of a height-adjustable ring at the bottom of the rushing chamber This makes it possible to move the top edge of the autogenous bed upwards in such a way that an autogenous bed forms in the front along the collision ring and the secondary collision therefore is able to take place autogenously; or if the top edge is moved to halfway up the collision ring a hybrid effect is obtained, the material impinging partially autogenously and partially on the collision ring. In addition to reducing wear, this makes it possible substantially to control the intensity of the comminution process.

The method and device according to the invention provides a possibility for constructing the collision ring elements from which the stationary collision member is made up from a single solid collision ring or multiple collision rings stacked on top of one another. Collision of the material usually takes place at a certain level, i.e. central portion of the collision surface, hereinafter to be designated the collision surface.

The method and device of the invention provides a possibility for providing a collision ring element with a collision surface that is made up of individual collision elements, as a result of which the solid of revolution can acquire the shape of a polygon in the form of a regular polygon. Such a regular polygon is obtained on practical grounds because it is easier to construct tile individual collision elements with a straight impact surface. Once in operation, the impact surface wears and an annular (smooth) collision member is obtained fairly quickly.

The invention furthermore provides a possibility that the stationary collision member consists of elements positioned alongside one another some distance apart, the fronts of which elements essentially describe an as it were open annular collision surface. In which openings the material itself settles so that an annular collision surface is produced as a whole.

The method and device of the invention provides a possibility for making at least the collision surface of a material that is at least as hard as, but preferably harder than, the impacting material, In the latter case consideration can be given to a steel impact surface, hut also an impact surface at least partially composed of hard metal; for example fragments or bars of hard metal which have been accommodated in a metal matrix.

The numerous deterministic variation possibilities make it possible to load various types of materials in diverse ways, by which means the course of the comminution process can be accurately matched to the intended purpose; in which context it is furthermore possible to control or to adjust the process in a simple manner. Specifically, the purpose of comminution of material can vary widely. For instance, the aim can be to comminuted the material as finely as possible. The aim can also be to produce a specific grain size distribution or grain fraction. The process can also be carried out with the aim of converting irregularly shaped grains into grains having a more cubic shape; or removing a layer of clay or loam that has deposited on the grains and adhered tightly. A comminution process can also be selective, for example with the aim of separating off (pulverising) less hard (soft) constituents, so that material of a specific (minimum) hardness results. Another application is to remove specific mineral constituents that occur In a rock (ore).

Usually specially suited crushers—and often even several different types of crushers—by means of which the material is loaded in a very specific manner—have to be used for the different applications. The method and device according to the invention, on the other hand, make it possible to load the material in a wide variety of different, but essentially deterministic methods. The crusher according to the invention is therefore multifunctional and makes it possible to allow the material to impinge in three phases in different ways—with different intensities; and the crusher consequently has many possible applications:

For instance, it is possible to accelerate the material and to cause it to strike once, but free from interference, the annular collision surface at a predetermined impact velocity and at a predetermined angle of impact, and even at a predetermined impact location. With this procedure it is possible then further to guide the material into the autogenous bed for rendering it more cubic, or another form of after-treatment It is also possible first further to load the material with the aid of a moving (co rotating) impingement member before it is guided into the autogenous bed. In the latter case the second impact (impingement) takes place at a (very much) higher, but nevertheless accurately controllable, velocity.

It is also possible to load the material successively two or three times by allowing it to strike one or two co-rotating impact members, followed by a collision against the annular collision member. The co-rotating impact velocities can be accurately controlled as is the velocity of collision with the annular collision surface; nevertheless the successive impact velocities usually increase, the difference m velocity being readily controllable by making the impact surface wide (facing outwards). After the collision with the annular collision member, the material can be guided into the autogenous bed here as well, but can also first be loaded by unpinging on a co-rotating impingement member; which impingement can take place at a significantly higher velocity than the preceding impacts and collision.

In all cases it is possible accurately to control not only the impact velocity but also the angle of impact, and even the impact location, of the individual impacts, collisions and impingements, by means of which the intensity of loading can also be controlled, whilst the manlier or intensity of impacts, collisions and impingements is not substantially affected by wear of the collision partner.

Finally, the method and device of the invention provide a possibility for fitting the rotor with a balancing member, what is achieved by this means being that the rotor starts to vibrate less rapidly if it becomes unbalanced, for example as a result of irregular wear.

The device according to the invention thus makes it possible—in a simple and elegant manner—to allow the material to collide several times in an essentially completely deterministic manner, or at an essentially predetermined collision location, at an essentially predetermined collision velocity and at an essentially predetermined collision angle, air resistance being restricted to a minimum. By this means a high probability of breakage—and a high degree of comminution—is achieved, whilst the energy consumption is reduced, wear is restricted and a crushed product is produced which has a regular grain size distribution, a limited amount of undersize and oversize and a very good cubic grain configuration, the effect—i.e. the determinism—essentially not being influenced by the wear on the collision member, whilst the material docs not rebound (or at least rebounds to a much lesser extent) against the rotor, as a result of which wear on the outside of the rotor is prevented.

BRIEF DESCRIPTION OF THE DRAWINGS

For better understanding, the aims, characteristics and advantages of the method and the device of the invention which have been discussed, and other aims, characteristic and advantages of the method and the device of the invention, are explained in the following detailed description of the method and the device of the invention in relation to the accompanying diagrammatic drawings.

BEST WAY OF IMPLEMENTING THE METHOD AND DEVICE OF THE INVENTION

A detailed reference to the preferred embodiments of the invention is given below. Examples thereof are shown in the appended drawings. Although the invention will be described together with the preferred embodiments, it mast be clear that the embodiments described are not intended to restrict the invention to these specific embodiments. On the contrary, the intention of the invention is to comprise alternatives, modifications and equivalents which fit within the nature and scope of the invention as defined by appended claims.

Figure 1:
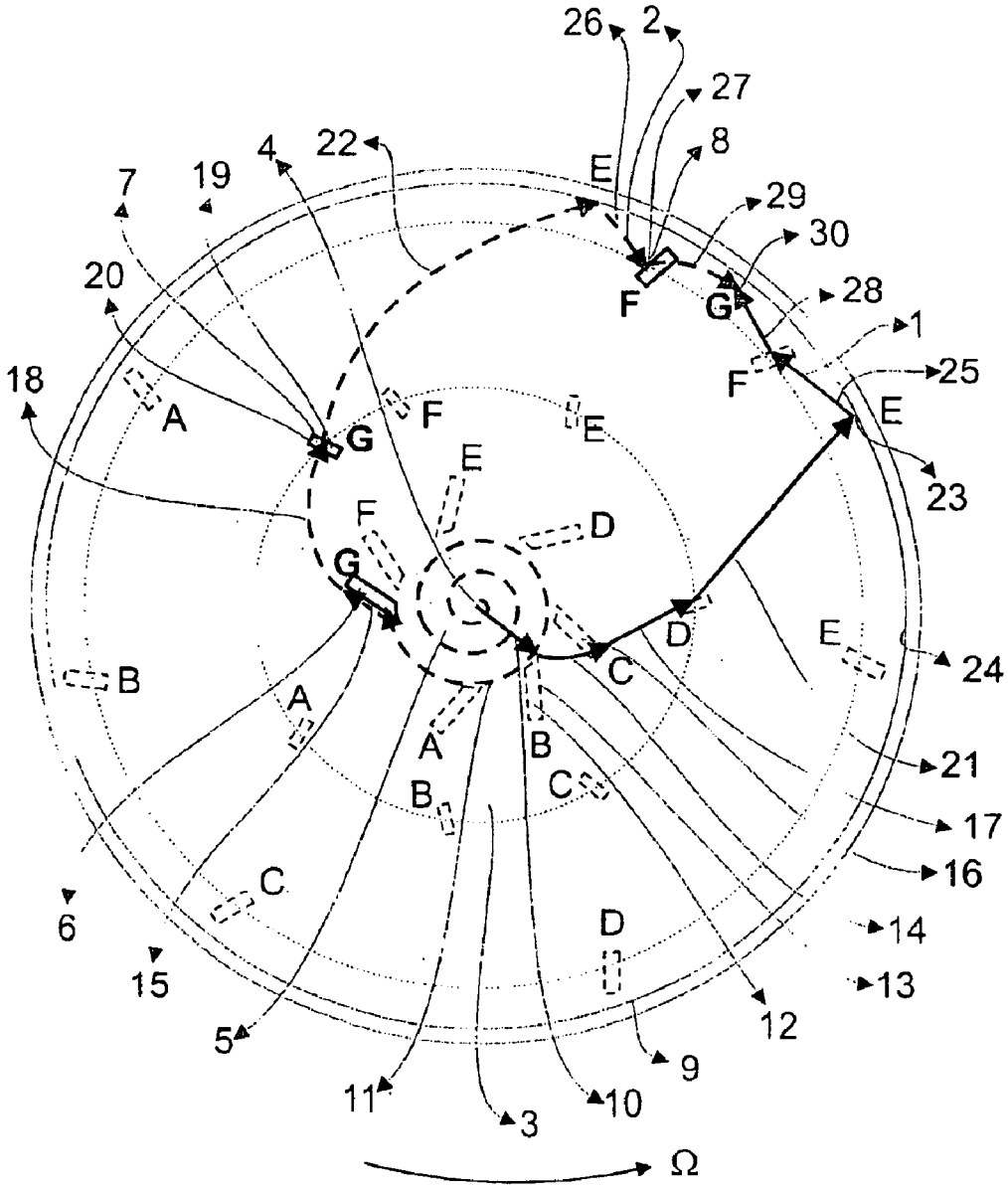
FIG. 1 describes the absolute and relative movement of the material in a rotary system in a specific configuration of a crusher according to the method of the invention.

FIG. 1 describes the movement of the material in a rotary system in a specific configuration of a crusher according to the method of the invention; and specifically describes an absolute movement (1) viewed from a stationary standpoint that is indicated by a continuous line and a relative movement (2) viewed from a standpoint co-rotating with the rotor, that is indicated by a broken line. The crasher according to the configuration in FIG. 1 is equipped with a rotor (3) that rotates about a vertical axis (4) of rotation and is provided with a central section (5) onto which the material is metered, a guide member (6), a co-rotating impact member (7) and a co-rotating impingement member (8). A stationary collision member (9) in the form of an annular collision surface is arranged around the rotor (3). The movements are indicated in a number of successive phases, i.e. A to G, the position of the guide member (6), the co-rotating impact member (7) and the co-rotating impingement member (8) being indicated for each phase The absolute and relative movements are indicated at point in time (G), i.e. after the grain has left the co-rotating impingement member (8).

During the first phase A (→B) the material moves along the central section (5) towards the outside; in the absolute sense along a virtually radial stream (10) and in the relative sense along a spiral stream (11) that is oriented backwards.

During the phase B (→C) the material is picked up by the guide member (12) and under the influence of centrifugal force moves along the guide surface (13) towards the outside, in the absolute sense along a spiral stream (14) that is oriented forwards and in the relative sense in a stream (15) that is oriented along the guide surface (13)

During the phase C (→D) the material leaves the guide member (16) and moves outwards; in the absolute sense along a first straight stream (17) that is oriented forwards and in the relative sense along a first spiral stream (18) that is oriented backwards.

During the phase D (→E) the material impinges on the co-rotating impact surface (20) of the co-rotating impact member (19) that is oriented transversely to the first spiral stream (11). The absolute impact describes a glancing blow and is not relevant here. The material then moves further outwards when it leaves the impact surface (20), in the absolute sense along a second straight stream (21) that is oriented forwards and in the relative sense along a second spiral stream (22) that is oriented backwards During the phase E (→F) the material collides at a collision location (23) with the collision surface (24) of the annular collision surface (stationary collision member) (9), the absolute movement along the second straight stream (21) applying; the spiral second stream (22) describes a glancing blow and is not relevant here. When it leaves the collision surface (24), the material then moves in the absolute sense along a third straight stream (25) that is oriented forwards and in the relative sense along a third spiral stream (26) that is oriented backwards.

During the phase F (→G) the material impinges on the impingement surface (27) of the co-rotating impingement element (8) that is arranged transversely in the third spiral path (26); the absolute third straight stream (25) describes a glancing blow and is not relevant here. Point G is in the same location (30) for both the absolute stream (1) and the relative stream (2).

The material then moves towards G; in the absolute sense along a fourth straight path (28) that is oriented forwards and in the relative sense along a fourth spiral stream (29) that is oriented backwards.

Figure 2:
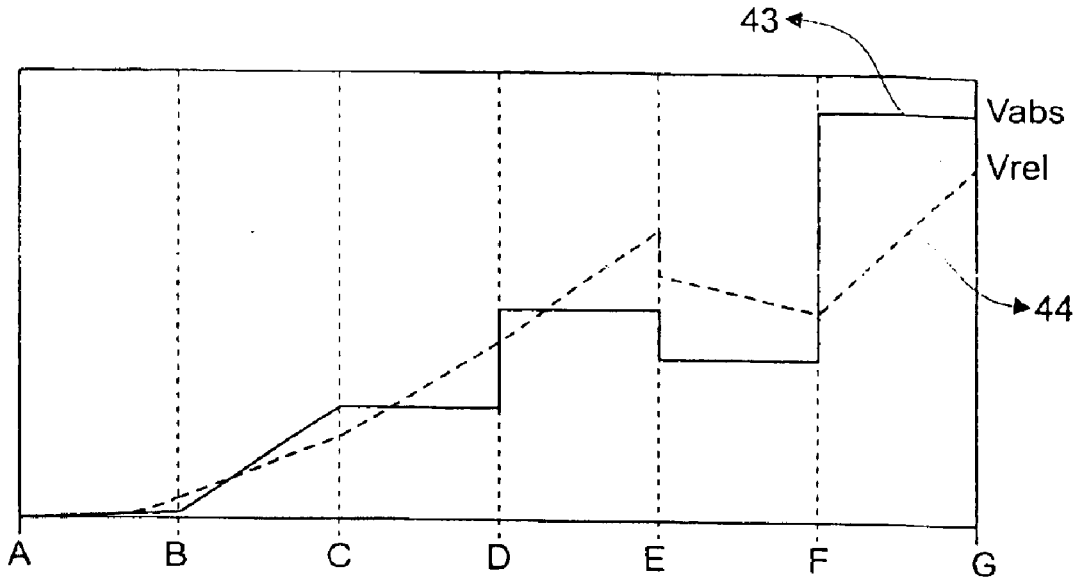
FIG. 2 shows the development of the radial and transverse velocity components and the absolute velocity according to FIG. 1.

The absolute (Vabs) (43) and relative (Vrel) (44) velocities which the material develops during the various phases in this operation is indicated highly diagrammatically in FIG. 2, the absolute velocity again being indicated as a continuous line and the relative velocity as a broken line. Relevant parameters for the rotary system are, for phase A (→B) the absolute and relative velocity, for phase B (→C) the relative velocity, for phase C (→D) the relative velocity, for phase D (→E) the absolute velocity, for phase E (→F) the relative velocity and for phase F (→G) the absolute velocity if the material is further guided into the autogenous bed of its own crushed material below the annular collision surface; and the relative velocity if the material again impinges on a second co-rotating impingement element (not indicated here), the impact surface of which is arranged transversely in the fourth spiral path (29); which, of course, is possible, optionally after the material has collided for the second time with the annular collision surface (stationary collision member) (9).

It is, of course, possible to choose other configurations (not indicated heir), such as guide member and annular collision surface; guide member, annular collision surface and impingement member; guide member, co-rotating impact member (and optionally a second co-rotating impact member) and annular collision surface, optionally followed by an impingement member (and even a second impingement member).

As already indicated, the final (absolute) residual velocity (G) can be used by guiding the material into an autogenous bed of its own crushed material (not indicated here).

Figure 3:
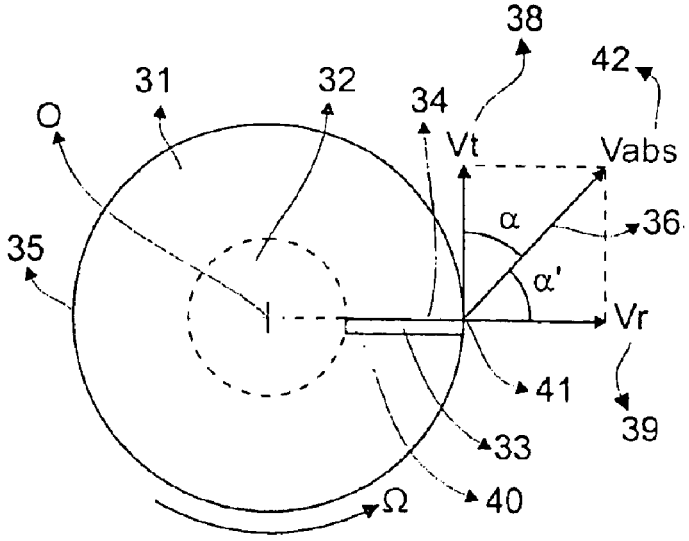
FIG. 3 shows, diagrammatically, a first rotor equipped with a radially oriented movement member and describes the movement of the material that is accelerated.

FIG. 3 shows, diagrammatically, a First rotor (31) that rotates at a rotational velocity (Ω) about an axis of rotation (O), flat is provided with a central section (32) that acts as a metering location, and an accelerator unit in the form of a movement member (33) that is provided with a movement surface (34) that acts as accelerator surface, which movement surface (34) here extends radially from a feed location (40) towards the outer edge (35) of said rotor (31), The material is picked up from said metering location (32) at said feed location (40) by said movement member (33) and is then accelerated along the movement surface (34), that here is of radial construction, under the influence of centrifugal force, the material building up a radial (vr) (39) and a transverse (Vt) (38) velocity component. The accelerated material is then propelled outwards from said outer edge (35) of said rotor (31) at a take-off location (41), at a take-off velocity (Vabs) (42) and at a take-off angle (a) (37), along a straight ejection stream (36) that is oriented forwards, viewed in the plane of the rotation, viewed in the direction of rotation (Ω) and viewed from a stationary standpoint. This figure also indicates the first angle of movement ($\alpha'=90°-\alpha$) that the material makes with said straight ejection stream (36) viewed from the axis of rotation (O). The take-off velocity (Vabs) (42) and the take-off angle (α) (37) are determined by the magnitudes of the radial (Vr) (39) and transverse (Vt) (38) velocity components and it is clear that the highest take-off velocity (Vabs) (42) is obtained when the radial (Vr) (39) and transverse (Vt) (38) velocity components are identical. This is usually the case if the movement surface is arranged radially, or even better oriented slightly forwards.

Figure 4:
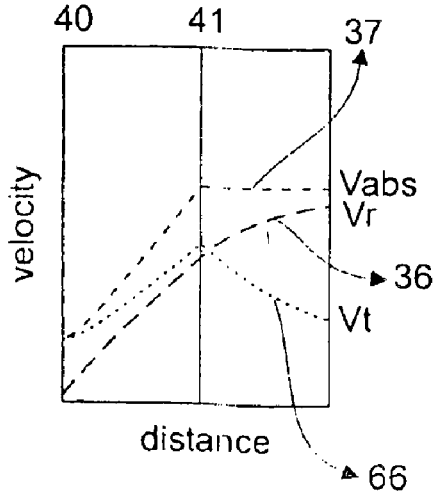
FIG. 4 shows the development of the radial (Vr) and transverse (Vt) velocity components and the absolute velocity (Vabs) of the first rotor.

FIG. 4 shows the development of the radial (Vr) (36) and transverse (Vt) (66) velocity components and the absolute velocity (Vabs) (37) that the material develops along the movement surface (34) of said first rotor (31), as a function of the distance that is travelled by the material along the movement surface (34), from the feed location (40) to the take-off location (41); and then from said take-off location (41) along said straight path (36). At the take-off location (41) the radial (Vr) (36) velocity component is here somewhat smaller than the transverse (Vt) (66) velocity component, with the consequence that the take-off angle (α) is somewhat smaller than 45° (when the transverse (Vt) (66) and radial (Vr) (36) velocity components are identical the take-off angle (α) is 45°). From the take-off location (41) the material moves at a constant take-off velocity (Vabs) (37) along said straight path (36); the radial (Vr) (36) velocity component increasing and the transverse (Vt) (66) velocity component decreasing as the material moves further away from the axis of rotation (O).

Figure 5:
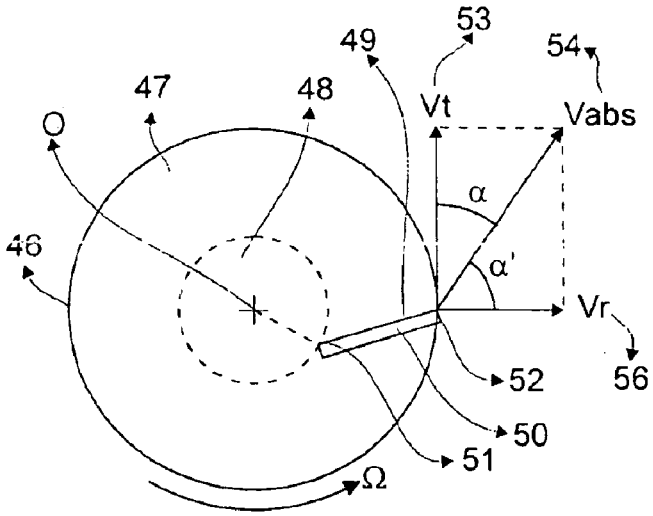
FIG. 5 shows, diagrammatically, a second rotor equipped with a movement member that is oriented forwards and describes the movement of the material that is accelerated.
Figure 6:
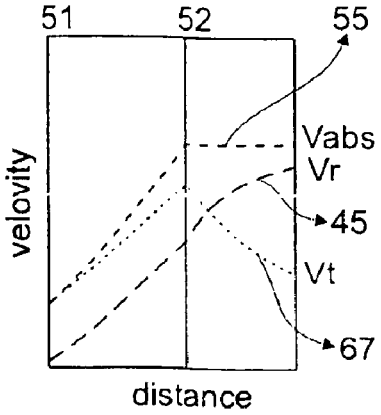
FIG. 6 shows the development of the radial (Vr) and transverse (Vt) velocity components and the absolute velocity (Vabs) of the second rotor.

FIGS. 5 and 6 describe, diagrammatically, a second rotor (47) similar to The rotor (31) from FIGS. 3 and 4, the movement member (50) being oriented obliquely forwards, viewed in the direction of rotation (Ω). As a result of orienting the plane of movement (49) forwards, the transverse (Vt) (53) velocity component is predominant; with the consequence that the takeoff angle (α) is smaller than 45° (and the first angle of movement (α') consequently is greater than 45°), whilst the take-off velocity (Vabs) (54) increases, compared with a radial set-up.

Figure 7:
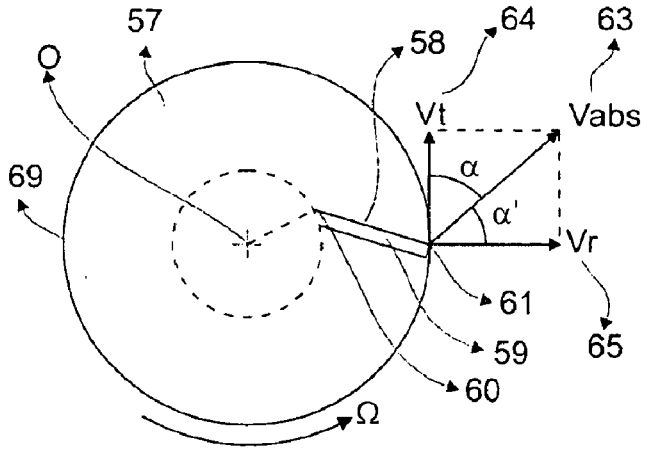
FIG. 7 shows, diagrammatically, a third rotor equipped with a movement member that is oriented backwards and describes the movement of the material that is accelerated.
Figure 8:
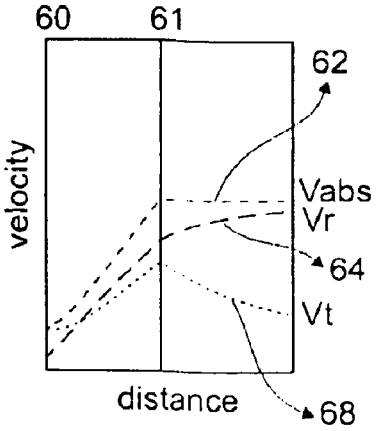
FIG. 8 shows the development of the radial (Vr) and transverse (Vt) velocity components and the absolute velocity (Vabs) of the third rotor.

FIGS. 7 and 8 describe, diagrammatically, a third rotor (57) similar to the rotor (31) from FIGS. 3 and 4, the movement member (59) being oriented obliquely backwards, viewed in the direction of rotation (Ω). The radial (Vr) (65) velocity component is predominant, as a result of which the take-off angle (α) increases and is greater than 45° (and the first angle of movement (α') is smaller than 45°), whilst the take-off velocity (Vabs) (63) decreases, compared with a radial set-up.

Figure 9:
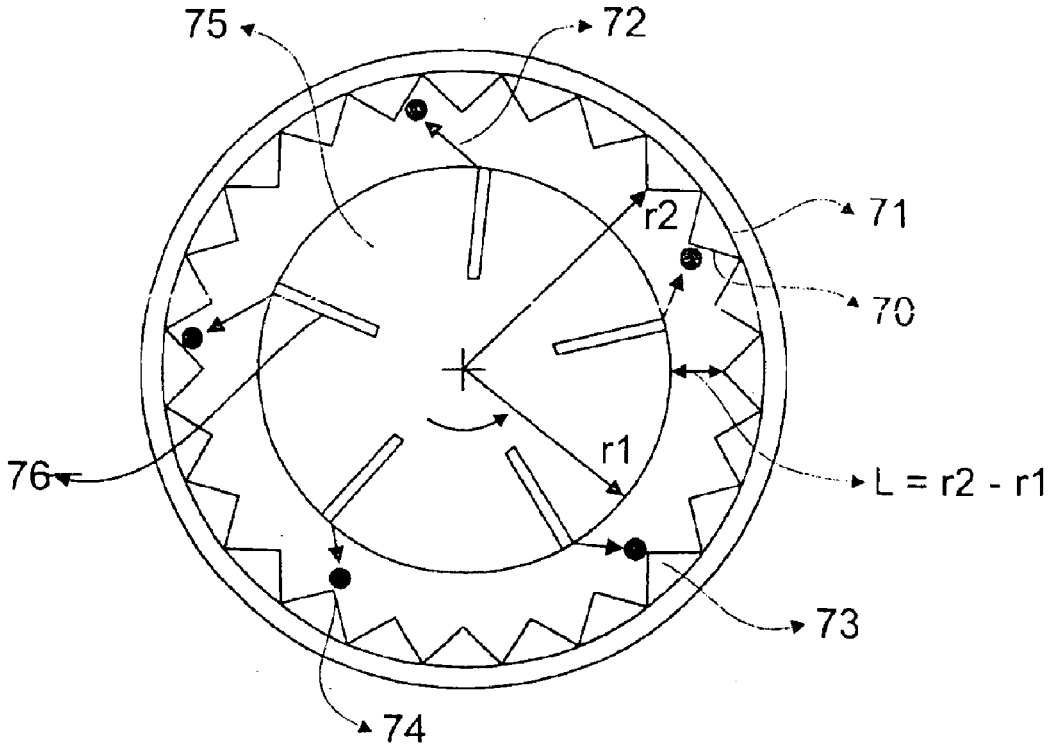
Fig. 9 (prior art)
FIG. 9 (prior art) shows, diagrammatically, the stationary impact member of a single impact crusher that has a knurled shape.

It is thus possible to influence the take-off angle (α) and the take-off velocity (Vabs) to a large extent with the aid of the positioning of the movement member. The take-off velocity (Vabs) increases and the take-off angle (α) decreases the flyer the movement surface is oriented forwards. The take-off angle (α) increases and the take-off velocity (gabs) decreases the further the movement surface is oriented backwards, As is indicated diagrammatically in FIG. 9 (prior art), in the known impact crusher the impact surfaces (70) of the stationary collision member (71) are oriented transversely to said straight stream (72). The stationary collision member (71) is usually made up of armoured ring elements (73) and as a whole has a knurled edge. Collision of the material stream on that stationary collision member (71) is highly disturbed by the edges of the projecting corners (74) of the armoured ring elements (73). The impact crusher shown here is equipped with a rotor (75) that is provided with acceleration members (76) by means of which the material is accelerated and propelled outwards. It is possible to equip the rotor (75) with guide members with associated impact members (multiple impact crusher).

Figure 10:
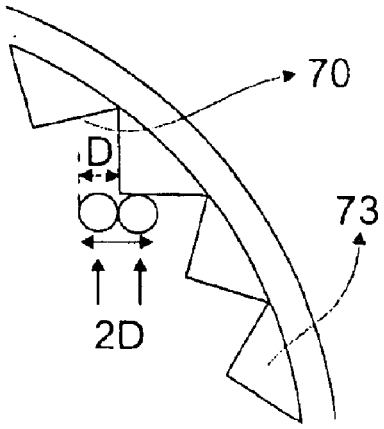
Fig. 10 (prior art)
FIG. 10 (prior art) shows, diagrammatically, a detail of the stationary impact member of a single impact crusher that has a knurled shape.
Figure 11:
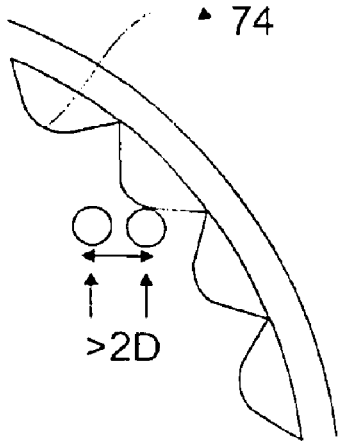
Fig. 11 (prior art)
FIG. 11 (prior art) shows, diagrammatically, a detail of the stationary impact member of a single impact crusher that has a knurled shape.

As is indicated diagrammatically in FIG. 10 (prior art), the interference effect that is caused by the projecting points (74) is fairly large and can be indicated as the length that is calculated by multiplying twice the diameter (D) of the material to be crushed by the number of projecting corner points (74) of the armoured ring compared with to the total length, i.e. the circumference, of the armoured ring. Thus, it can be calculated that in the known single (multiple) impact crushers more than half of the grains in the stream of material are subjected to a substantial interference effect during collision with the stationary collision member. As is indicated diagrammatically in FIG. 11 (prior art), this interference effect furthermore also increases substantially as the projecting corners (74) are rounded off under the influence of wear, which usually takes place fairly rapidly.

In the known direct multiple impact crusher (not shown here) the first collision with the moving impact member takes place without interference and entirely deterministically. The second impact, however, here also takes place against a (knurled) armoured ring and the determinism is again disrupted by the projecting points.

The method and device of the invention provide a possibility for completely eliminating this interference effect.

Figure 12:
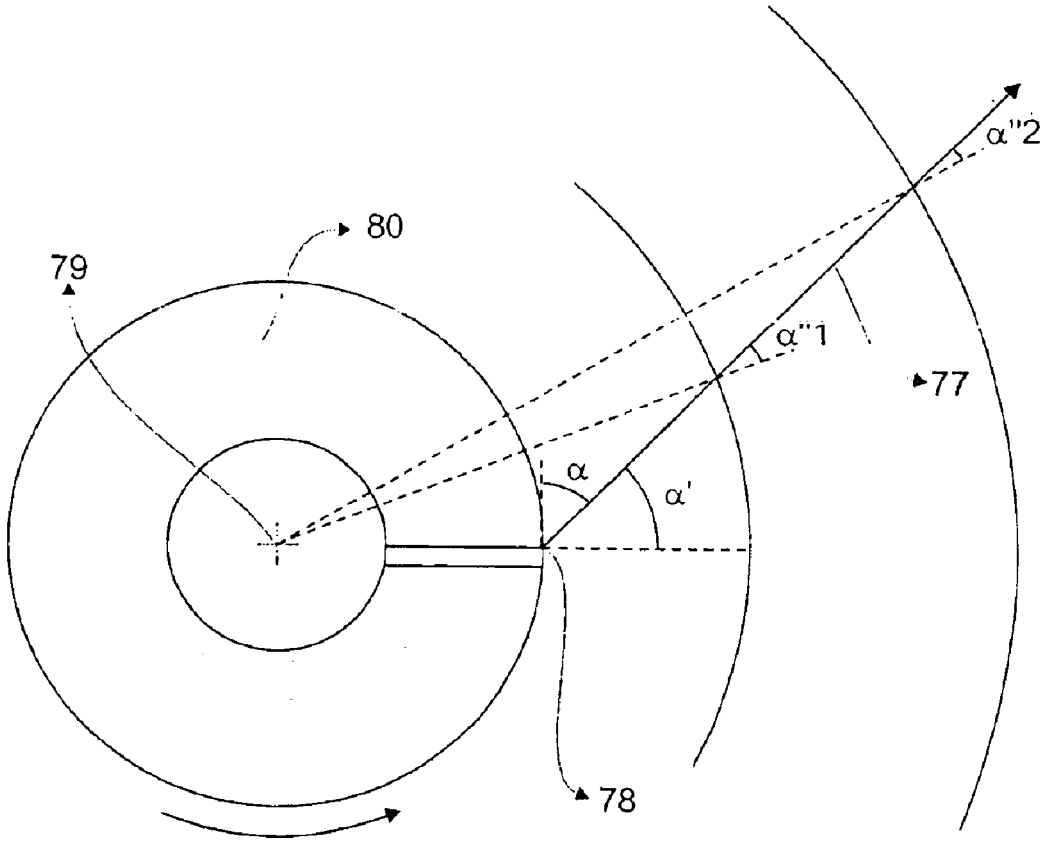
FIG. 12 describes, diagrammatically, the movement of the material along a straight stream.

As is indicated diagrammatically in FIG. 12, the take-off angle (α) essentially determines the first angle of movement ($\alpha'=90°-\alpha$) and this angle of movement changes when the material moves along said straight stream (76), there being said to be an apparent angle of movement (α"). As the material moves further away from the axis of rotation along said straight stream the apparent angle of movement (α") always becomes smaller. The take-off angle (α) and the shift in the apparent angle of movement (α") can be calculated reasonably accurately and simulated with the aid of a computer (see U.S. Pat. No. 5,860,605) or established with the aid of high-speed video recordings.

This cause of the shift in the apparent angle of movement (α") is that the grain leaves the take-off location (78) some distance away from said axis of rotation (79) of the rotor (80); as a result of which the polar coordinates of the axis of rotation (79) are not coincident with the polar coordinates of the takeoff location (78). As a result there is an—apparent—shift in the velocity components along the straight ejection stream (77) that the grain follows; as already indicated diagrammatically in FIGS. 3 to 8. When the material moves further away from the axis of rotation (79) the absolute velocity (Vabs) remains the same but the radial velocity component (Vr) increases, whilst the transverse velocity component (Vt) decreases. The consequence of this is that the material—apparently—starts to move in an increasingly more radial direction, viewed from the axis of rotation (79), the further it moves away from the axis of rotation (79).

Figure 13:
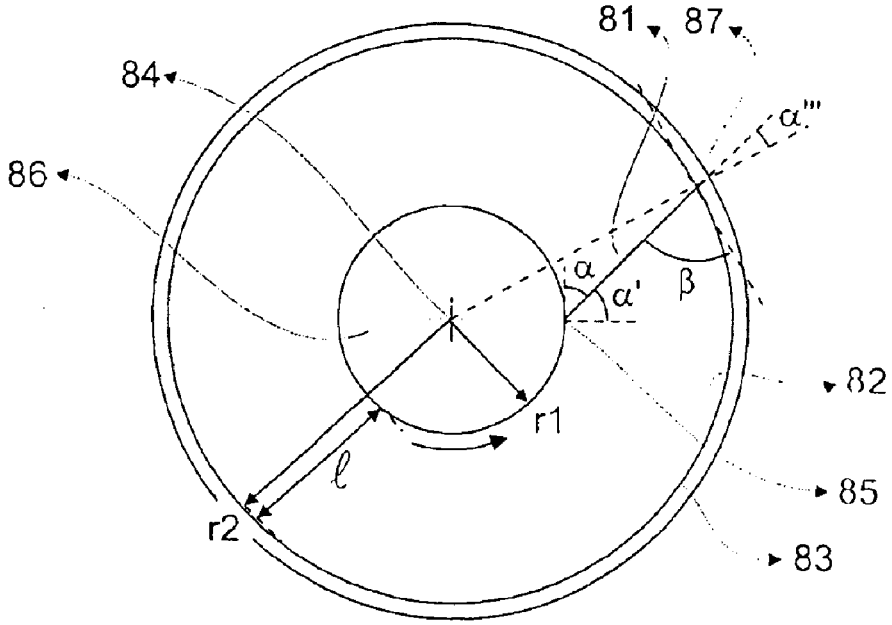
FIG. 13 describes, diagrammatically, the movement of the material along a straight stream.

As is indicated diagrammatically in FIG. 13, the method and device of the invention make use of this shift (decrease) in the apparent angle of movement (α") along said straight ejection stream (81), which offers the possibility of allowing the material to collide without interference and at a predetermined optimum collision angle (β=90°−α''')—i.e. entirely deterministically—with the collision surface (82) of the stationary collision member (83) by:

constructing the collision member (83) with a collision surface (82) in the form of a solid of revolution, or in the form of a smooth ring, the axis of revolution (84) of which solid of revolution is coincident with the axis of rotation (84);

choosing the radial distance along the radial line between the take-off location (85) where the material leaves (ri) the rotor (86) in relation to the radial distance to the collision surface (r2) (82) at least so great that the material impinges on the collision surface (82) at a collision location (87) at an essentially predetermined collision angle (β), which preferably is greater than or equal to 70°; but in any event is greater than 60°; so that the grain is sufficiently loaded during the collision in order to be able to crush.

The radial distance (r2−r1) is determined by the take-off angle (α) and can be indicated as the ratio (r2/r1) that essentially must comply with the equation:

$$\frac{r_2}{r_1} \geq \frac{\cos\alpha}{\cos\left(\frac{\beta}{180}\pi\right)}$$

r1=the first radial distance from said axis of rotation to said take-off location (94).

r2=the second radial distance from said axis of rotation to said collision location (87).

α=the take-off angle between the straight line having thereon said take-off location (85) that is oriented perpendicularly to the radial line from said axis of rotation having thereon said take-off location (85) and the straight line, from said take-off location (85), that is determined by the movement of said material along said straight ejection stream (81).

β=the collision angle between the straight line having thereon said collision location (87) that is oriented perpendicularly to the radial line from said axis of rotation having thereon said collision location (87) and the straight line from said take-off location having thereon said collision location (87).

Figure 14:
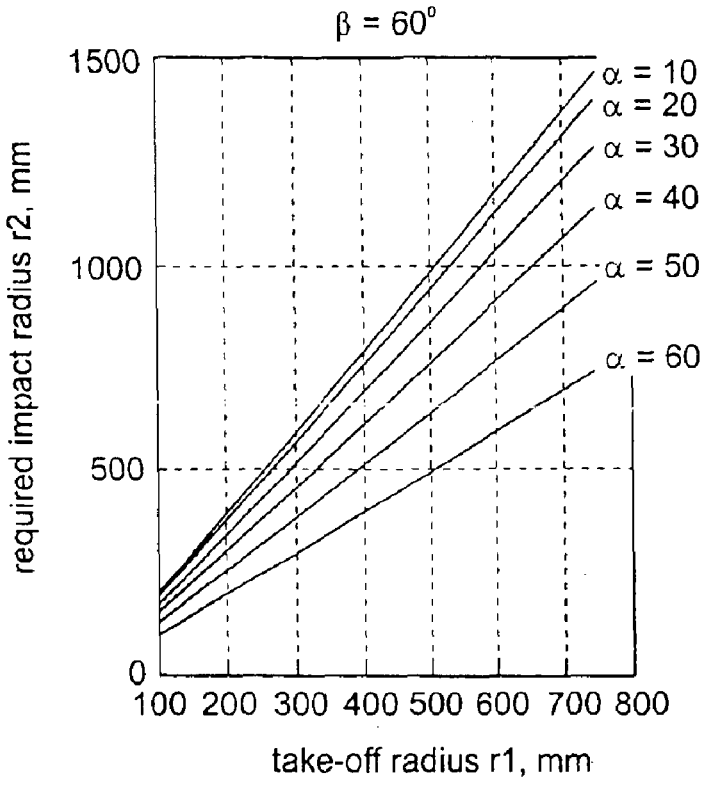
FIG. 14 shows the relationship between the take-off radius (r1) and the required collision radius (r2) for a collision angle (β) of 60°.
Figure 15:
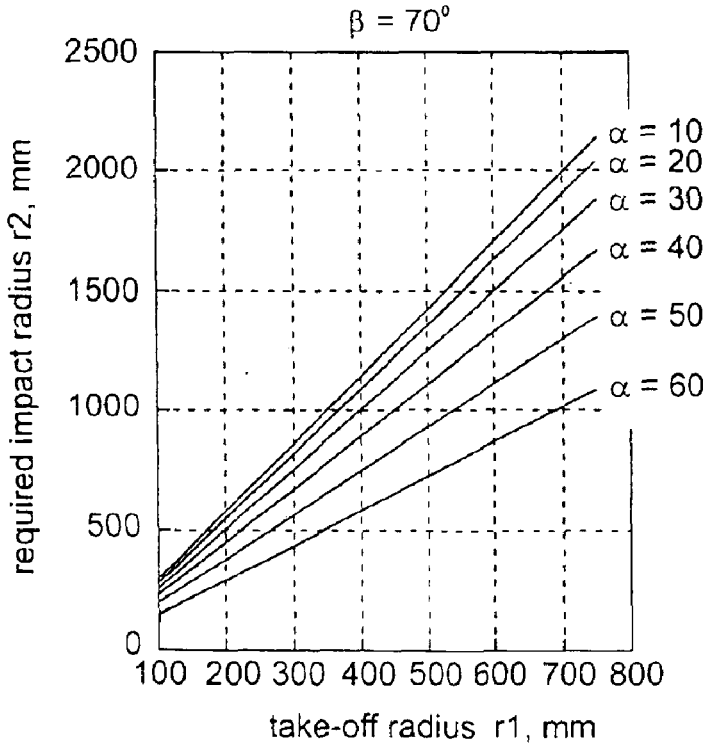
FIG. 15 shows the relationship between the take-off radius (r1) and the required collision radius (r2) for a collision angle (β) of 70°.
Figure 16:
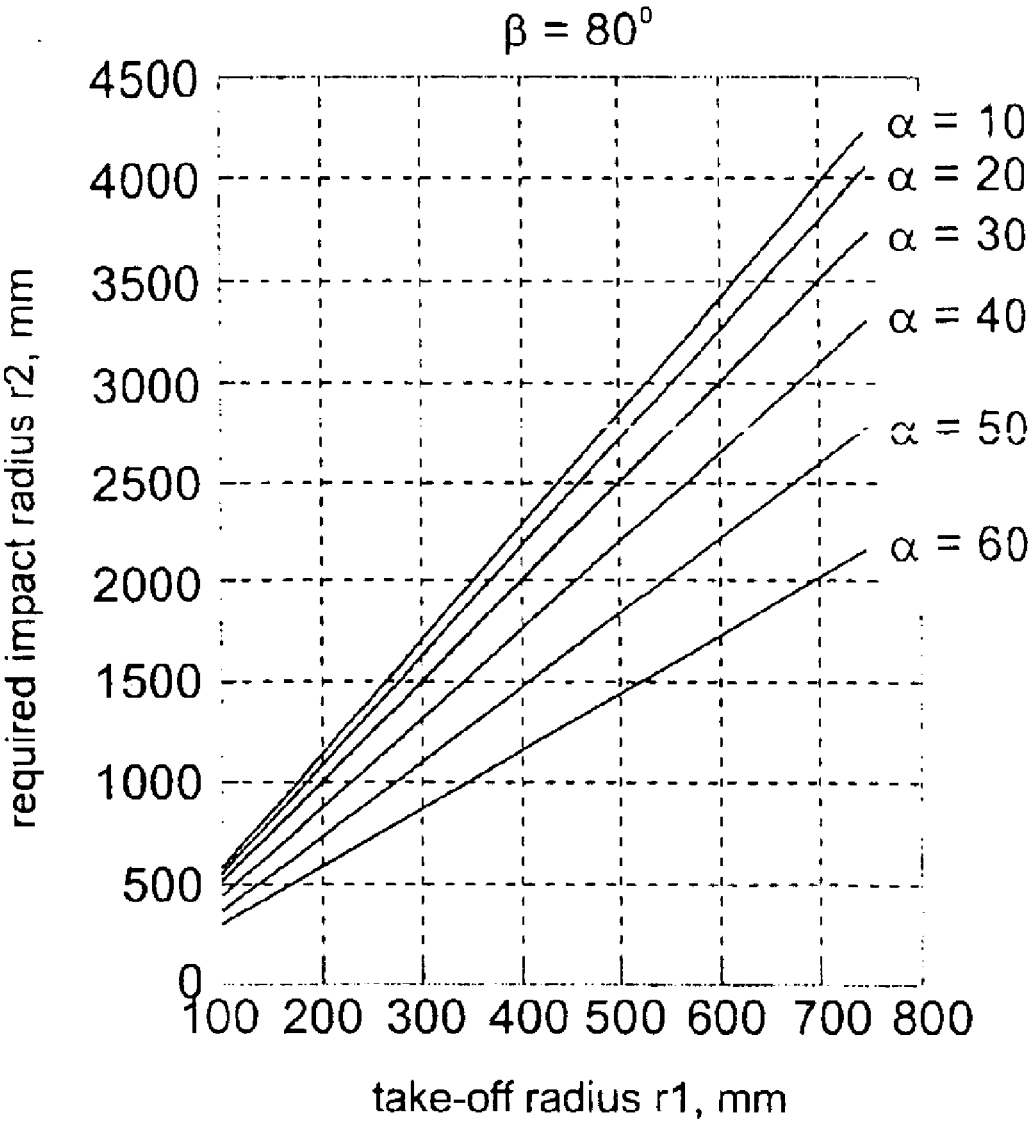
FIG. 16 shows the relationship between the takeoff radius (r1) and the required collision radius (r2) for a collision angle (β) of 80°.

FIGS. 14, 15 and 16 show the relationship between the take-off radius (r1) and the collision radius (r2) required to achieve collision angles (β) of 60°, 70° and 80°, respectively, for take-off angles (α) of 10°, 20°, 30°, 40°, 50° and 60°. In order to achieve a collision angle (β) greater than 60°, and preferably 65°–75°, the radial distance between the rotor (r1) and the collision ring (r2) must be chosen fairly large, but can be restricted if the take-off angle (α) increases.

Especially in the case of the known single impact crusher, where the material is propelled outwards from the acceleration member towards the stationary collisions member and the take-off angle (α) is usually no greater than 35°–40°, the radial distance must be chosen fairly large. For a takeoff angle (α) of 37.5° the ratio (r2/r1) must be set at ~2.4 in order to achieve a collision angle (β) of 70°, at ~4.5 for a collision angle (β) of 80° and at ~1.5 for a collision angle (β) of 60°.

Figure 17:
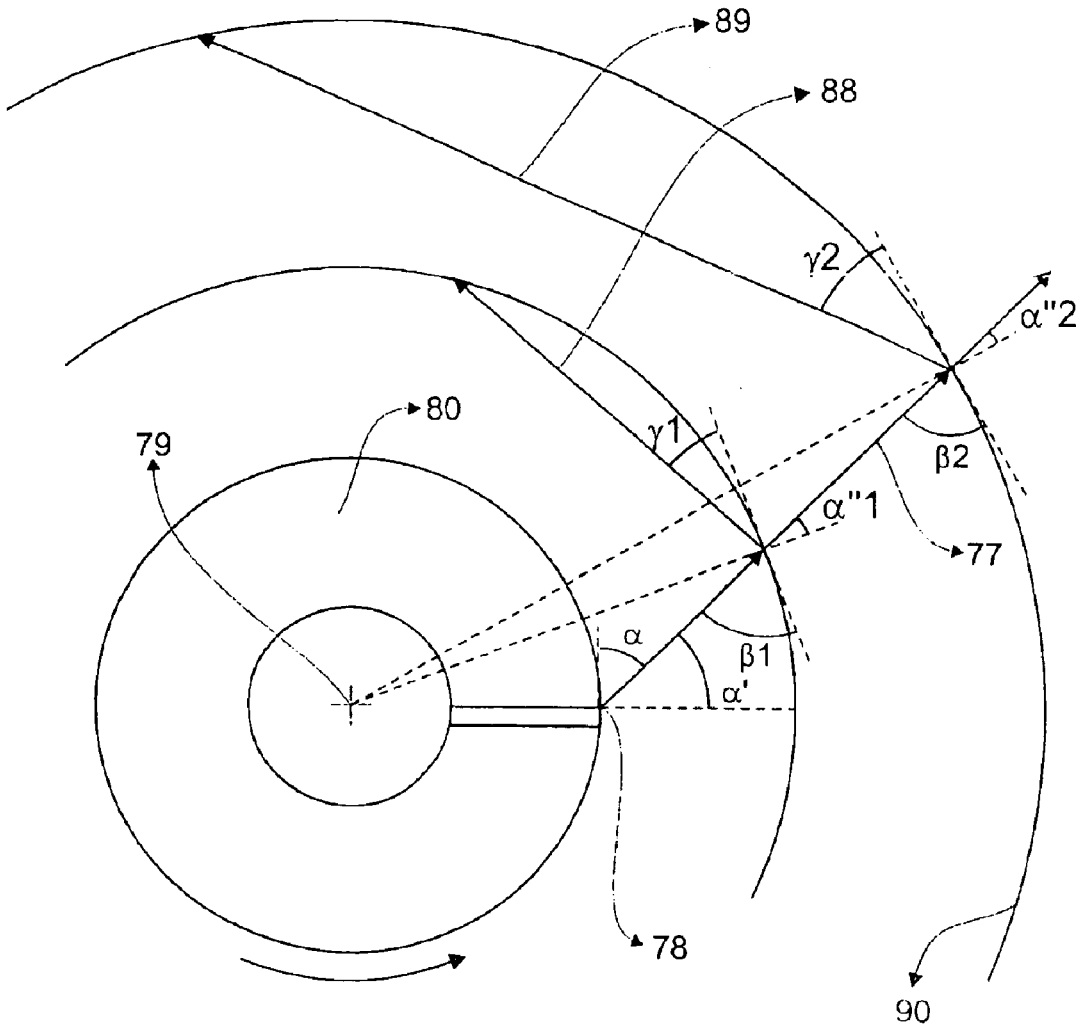
FIG. 17 shows, diagrammatically, the shift in the apparent angle of movement along the straight ejection stream and the increase in the angle of impact as the radial distance from the axis of rotation increases.

FIG. 17 shows, diagrammatically, the shift in the apparent angle of movement (α") along the straight ejection stream (77) and the iincrease in the angle of impact (β1→β2) as the radial distance from the axis of rotation (79) increases. The rebound angle (γ) also increases as the angle of impact (β) increases; although there is no question here of angle of impact=rebound angle because the material is deflected in the tangential direction by the stream of air co-rotating with the rotor. The rebound lines (88) (89) along which the material moves after impact describe a longer chord as the rebound angle (γ) increases. A longer chord limits wear along the collision surface (90) and makes it possible better to guide the material into the autogenous bed of crushed material (not indicated here).

Figure 18:
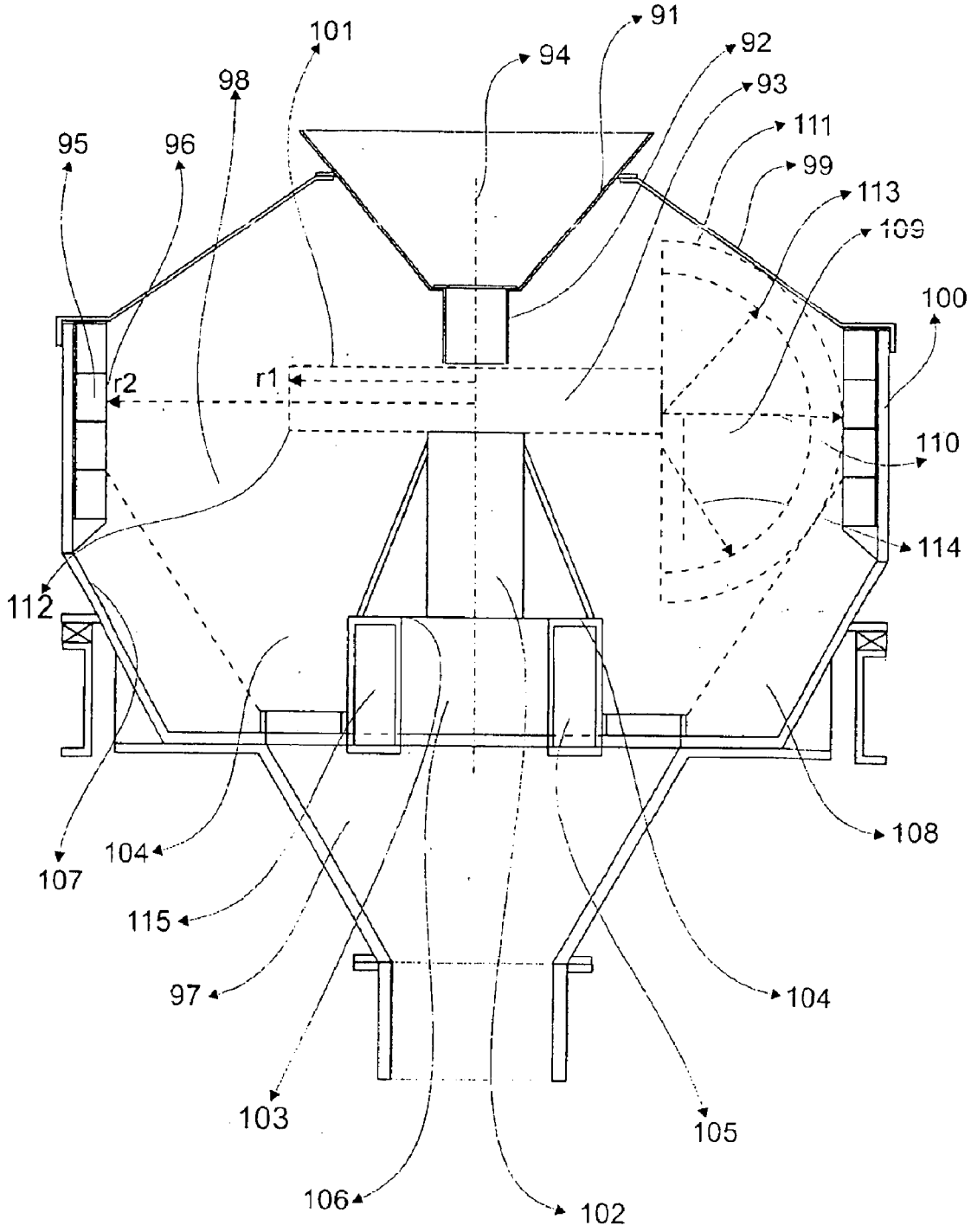
FIG. 18 shows, diagrammatically, a cross-section of a first basic device according to the method of the invention.

FIG. 18 describes, diagrammatically, a device according to the invention, which is preferred, where the material is metered with the aid of the metering member, which here is constructed as a funnel (91) with a tubular outlet (92), through an inlet in a rotor (93) (indicated diagrammatically here) that can be rotated in at least one direction about a vertical axis of rotation (94). The material is accelerated with the aid of the rotor (93) and propelled outwards from said rotor (93) a radial distance (r1) away from said axis of rotation (94) onto a stationary collision member (95), the material breaking (if the velocity is sufficiently high). The stationary collision member (95) is in the form of a solid of revolution, the axis of revolution of which is coincident with the axis of rotation (94). Here the solid of revolution is constructed as a collision ring member that is constructed with a cylindrical collision surface (96); which cylindrical collision surface (96) is arranged a radial distance (r2) away from said axis of rotation (94). The impact on the collision surface of said stationary collision member (95) (that is not affected by projecting points as is the case with the known impact crushers) consequently takes place in an essentially entirely deterministic manner; that is to say at an essentially predetermined collision location, with an essentially predetermined impact velocity and at an essentially predetermined collusion angle. The ratio (r2/r1) is so chosen that the material impinges on the collision surface (96) at a collision angle (β) that preferably is equal to or greater than 70°. It is important that the determinism (the collision angle) is essentially unaffected when the collision member starts to wear, After collision with the stationary impact member (96) the material drops down and is guided to the outside via an outlet (97) in the bottom of the crasher chamber (98).

The method and device of the invention provides a possibility for even further reducing the air resistance, which is enormously reduced by the smooth collision ring, by making the crusher chamber (98) completely open and to this end provides a possibility for:

constructing the removable lid (99) of the crusher housing (100) in conical form so that a large upper chamber is produced between the top edge (101) of the rotor (93) and the inside of the lid (99);

supporting the shaft box (102) only along the underside (103), so that tile whirl chamber around the shaft box (102) remains fee (open);

restricting accumulation of material in the bottom of the crusher chamber (104) to a minimum by making the pulley case (105) on which the shaft box (102) is supported open in the middle (106);

constructing the bottom of the crusher chamber (104) in such a way that an autogenous conical bed (108) of the material itself builds up in this location in a collection chamber along the wall (107) below the stationary impact member (95).

By this means an open and streamlined crusher chamber (98), with a conical lid (99), that widens towards the bottom, above the rotor (93), a smooth armoured ring (95) around the rotor (93) a relatively large distance away and a free whirl chamber (109) below the rotor (93), with a conical autogenous bed, (108), that narrows towards the bottom, of the material itself below said whirl chamber, which whirl chamber (109) is not interrupted at any point around it by surfaces or other obstacles which can give rise to air resistance, is produced in the crusher housing (100) around the rotor (93), by which means the objective is achieved in an essentially simple and elegant manner. The free rotation chamber (109), in which no stationary members are located, can be defined with the aid of the free radius (110) that forms a semi-circle (111) that extends around the outer edge (112) of the rotor (93). It is preferable to allow the free radius (110) that defines the free rotation chamber (109) to extend in the radial direction from the centre (113) of the circle of the semi-circle (111) to the collision surface (96); a shorter free radius (114), with a length of, for example, 0.75 that of the free radius (110) which extends to the collision surface (96), can suffice on practical grounds.

Figure 19:
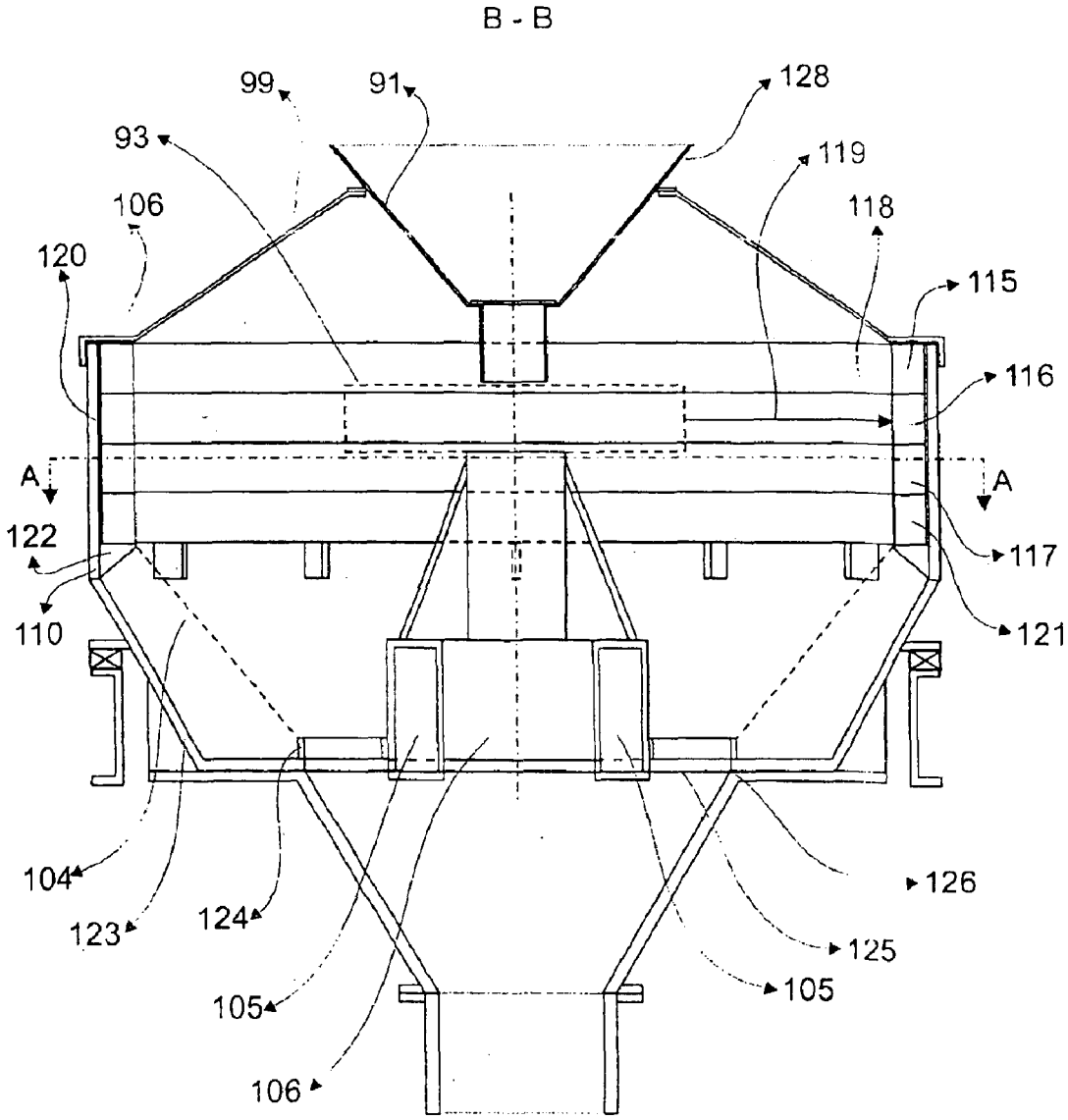
FIG. 19 shows, diagrammatically, a cross-section B—B of a device according to the method of the invention according to FIG. 20.
Figure 20:
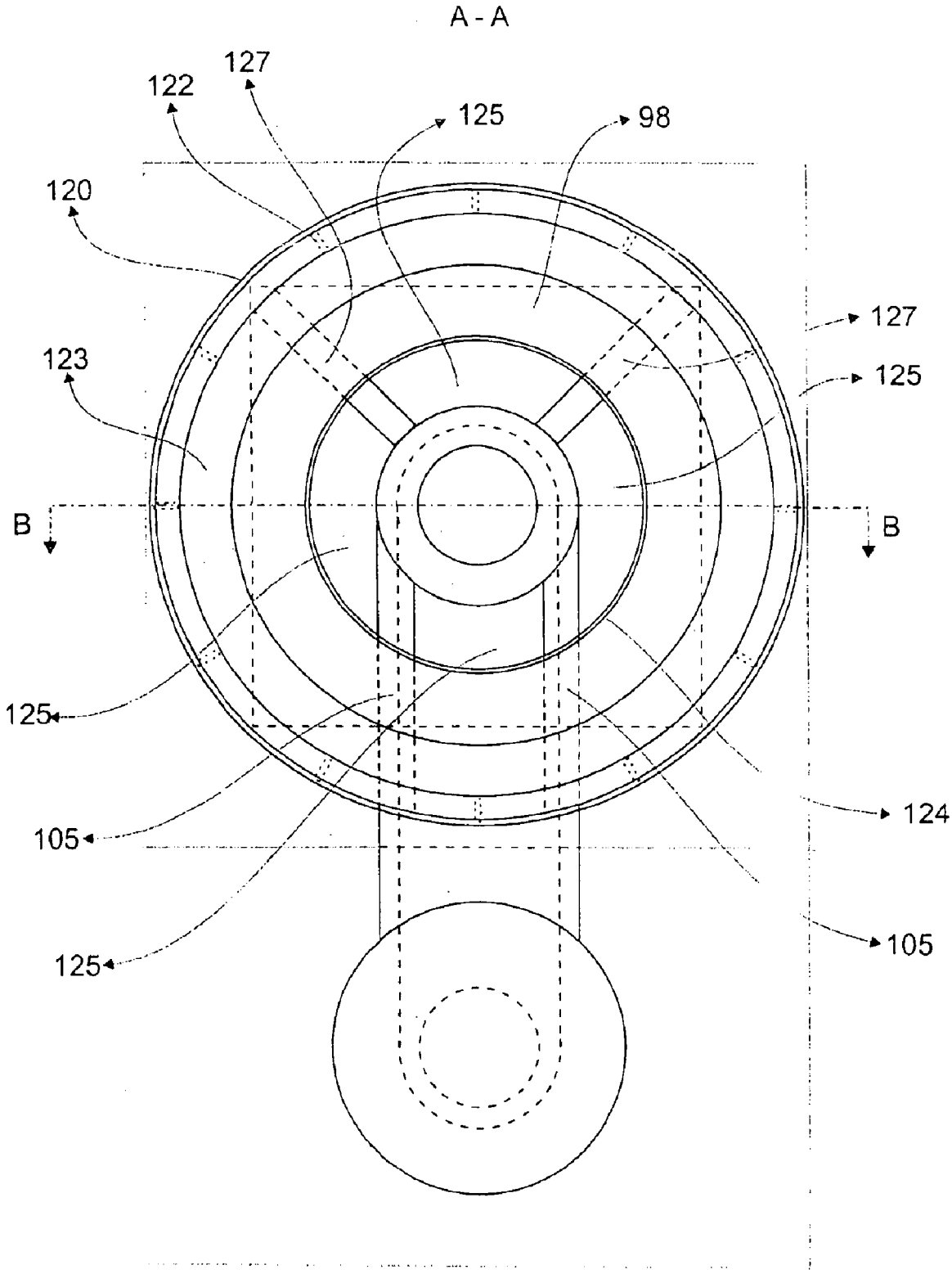
FIG. 20 shows, diagrammatically, a longitudinal section A—A according to FIG. 19.

As is indicated diagrammatically in FIGS. 19 and 20, which show, respectively, a cross-section of the crusher in FIG. 18, it is possible to make up the stationary collision member (96) of at least three collision ring elements (115)(116)(117) which are placed on top of one another, the impact surface (118) of the central collision ring element (116), that acts as collision surface, being oriented transversely to the straight stream (119) that the material describes when it is propelled outwards from the rotor (93), which impact surface (118) acts as collision surface. The adjacent collision ring elements (115)(117) collect a limited fraction of tho material and protect the outside wall (120) of the crusher housing (110); and these collision ring elements (115)(117) therefore wear to only a limited extent. This makes it possible to wear away the central collision ring element (116) virtually completely and then to replace it by one of the adjacent collision ring elements (115)(117), which, in turn, is then replaced by a new collision ring element. The method and device of the invention therefore enable extremely efficient use of the collision wear parts. It is possible also to support the three said collision ring elements (115)(116)(117) on one or more, preferably worn, collision ring elements (121), which then at the same time serve to protect the outside wall (110) at the bottom of the crusher chamber (104).

The collision ring member (96) can also be constructed as a single complete collision ring, i.e. in one piece; however, an assembly of three collision ring elements can be preferred because these are easy to produce, easy to replace, give much less wear compared with a knurled armoured ring and, moreover, can be used up virtually completely, i.e. worn away virtually completely. For comparison: because of the specific knurled design, frequently less than half—frequently only a quarter—of the armoured ring in the known impact crusher can be used up before this has to be replaced. The device of the invention provides the possibility for making up the individual collision ring elements from two or more segments.

Here the collision ring elements (115)(116)(117)(121) are supported on ridges (122) which are fixed to the outside wall (120) of the crusher chamber (98), The crusher wall (123) at the bottom of the crusher chamber (98) is constructed as a cone narrowing toward the bottom. This makes it possible easily to clean the crusher chamber (104), for which purpose the upright edges (124) around the outlet (125) of the crusher chamber (104) can easily be removed. These upright edges (124) Serge to protect the rim of the outlet (126) and to build up the autogenous bed (108) along the outside wall (107). As has been stated, the pulley case (105) in the crusher chamber (104) is constructed with an open inner space (106); essentially no material is able to accumulate on the pulley tubes (105). The rear of the pulley case (105) is not continued through the crusher chamber (104) but is supported with the aid of at least two supporting bars (127) on the outside wall (123) of the crusher chamber (104) so that here also no material is able to accumulate. The metering member (128) is partially recessed with the funnel (91) in the conical lid (99).

The method and device according to the invention where the stationary collision surface is constructed as a smooth (cylindrical) collision ring and is arranged an adequate distance away from the rotor thus make it possible—in an essentially simple and elegant manner—to allow the material to collide, optionally several times, in an essentially entirely deterministic manner, or at an essentially predetermined collision location, at an essentially predetermined collision velocity and at an essentially predetermined collision angle; by which means a high breakage probability—and thus the degree of comminution—is achieved, the energy consumption is reduced, wear is restricted and a crushed product is produced which has a regular grain size distribution, a restricted quantity of undersize and oversize and a very good cubic grain configuration, the effect—or the determinism—essentially not being influenced by wear of the collision member, whilst the material does not rebound (or at least rebounds to a much lesser extent) against the rotor.

Figure 21:
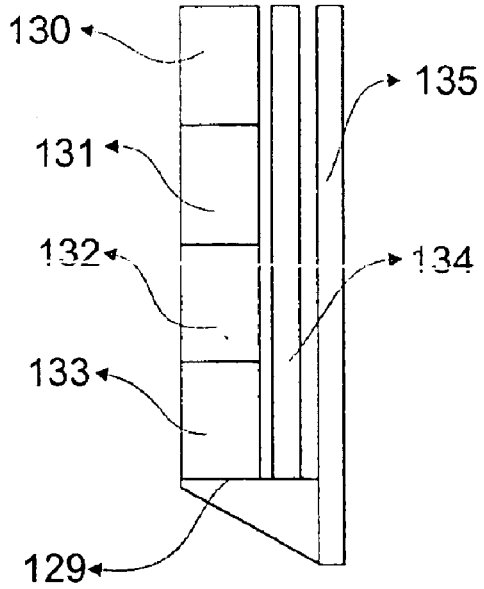
FIG. 21 shows, diagrammatically, a first detail of the stationary collision member.

FIG. 21 shows, diagrammatically, the stationary collision member (129) made up of four collision ring elements (130)(131)(132)(133) placed on top of one another, behind which a protective ring (134) is arranged, which prevents the outside wall (135) being damaged if one of the collision ring elements (130)(131)(132)(133) burns through. This protective sing (134) can also serve as support construction, by means of which the collision ring elements can be lifted in and lifted out together.

Figure 22:
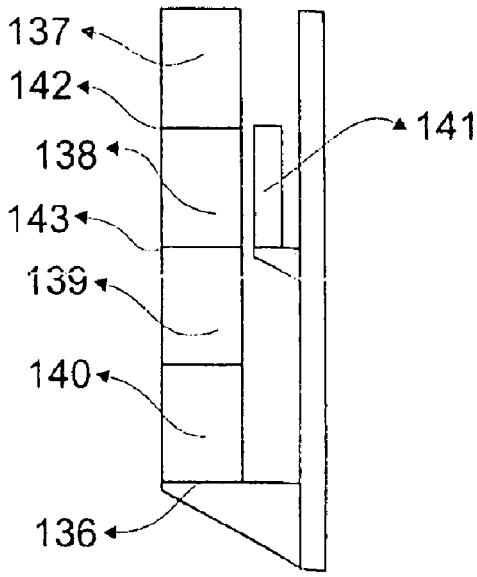
FIG. 22 shows, diagrammatically, a second detail of the stationary collision member.
Figure 23:
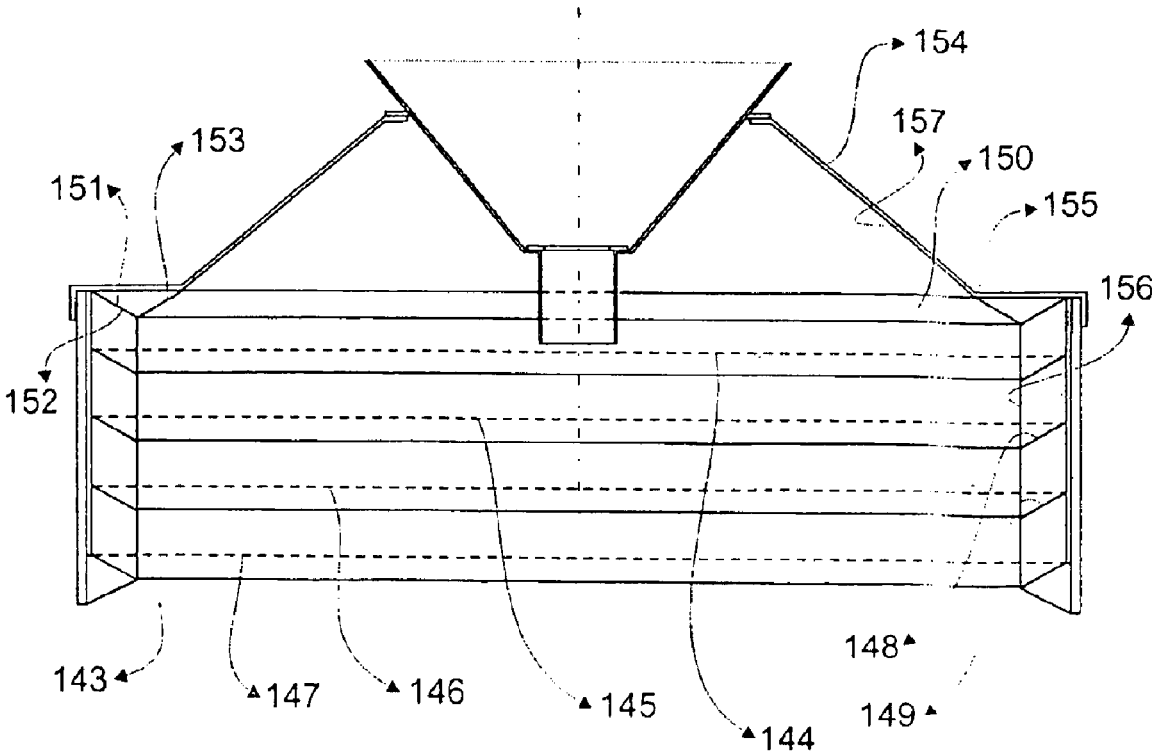
FIG. 23 shows, diagrammatically, a third detail of the stationary collision member.

FIG. 22 shows, diagrammatically, a stationary collision member (136) that is also made up of four collision ring elements (137)(138)(139)(140), the protective ring (141) extending between the top edge (142) and the bottom edge (143) of the central collision ring element (138) that is arranged transversely in the straight stream, FIG. 23 shows, diagrammatically, a stationary collision member (143) constructed with four collision ring elements (144)(145)(146)(147), the top edge (148) and bottom edge (149) of the collision ring elements (144)(145)(146)(147) being of conical construction (preferably in the form of a cone that narrows towards the bottom, such that the top edge (148) and the bottom edge (149) abut one another, what is achieved by this means being that the collision ring elements (144)(145)(146)(147) can more easily be positioned (centred) on top of one another and form a certain bond with one another. A collar member (150) can now easily be placed on the top collision ring element (144), which collar member (150) has a V-shape ill cross-section, the outside (151) of which forms a cone that narrows towards the bottom and abuts the conical upper surface (152) of the top collision ring element (144). The inside (153) of the collar member (150), which as a whole has a conical shape widening towards the bottom, preferably abuts the conical lid (154) and at the same time acts as wear-resistant protection at the location of the transition (155) from the collision surface (156) to the inside (157) of the lid (154).

Figure 24:
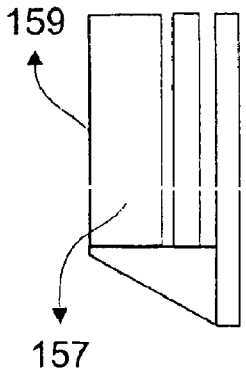
FIG. 24 shows, diagrammatically, a stationary collision member that is constructed as a single ring element.
Figure 25:
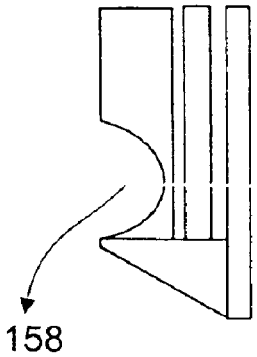
FIG. 25 shows, diagrammatically, a stationary collision member from FIG. 24, the collision surface of which is worn.
Figure 26:
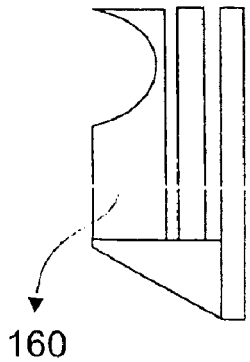
FIG. 26 shows, diagrammatically, a stationary collision member from FIG. 24, in which the single ring element is reversed.

FIGS. 24, 25 and 26 show, diagrammatically, a stationary collision member (157) that is constructed as a single ring element that can be reversed (160) when the bottom halt (158) that acts as collision surface (159) has worn.

Figure 27:
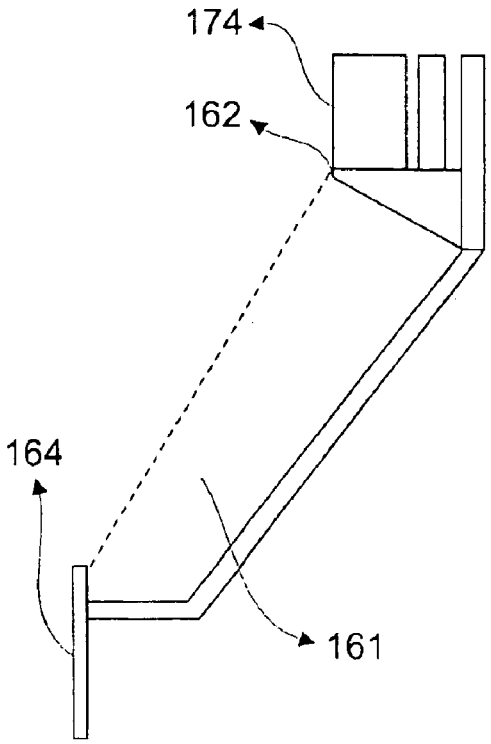
FIG. 27 shows, diagrammatically, an autogenous bed, the upper edge of which can be raised by adjusting the height of the upright plate edge.
Figure 28:
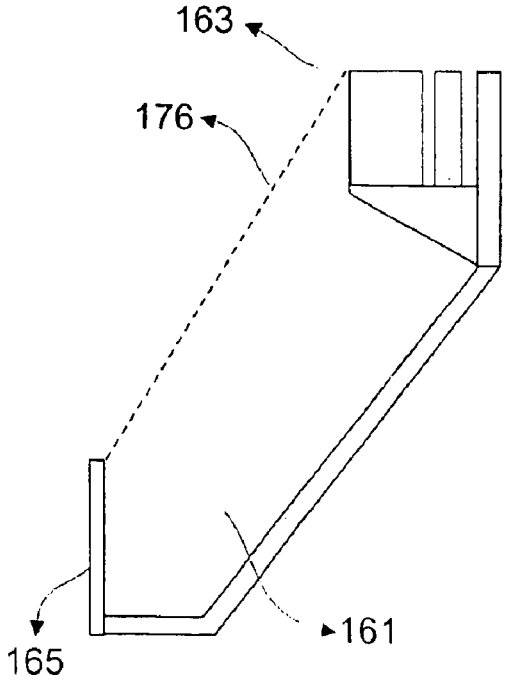
FIG. 28 shows, diagrammatically, an autogenous bed, the upper edge of which has been raised by adjusting the height of the upright plate edge.

FIGS. 27 and 28 show, diagrammatically, the autogenous bed (161), the upper edge (162→163) of which can be raised by adjusting the height of the upright plate edge (164→165).

Figure 29:
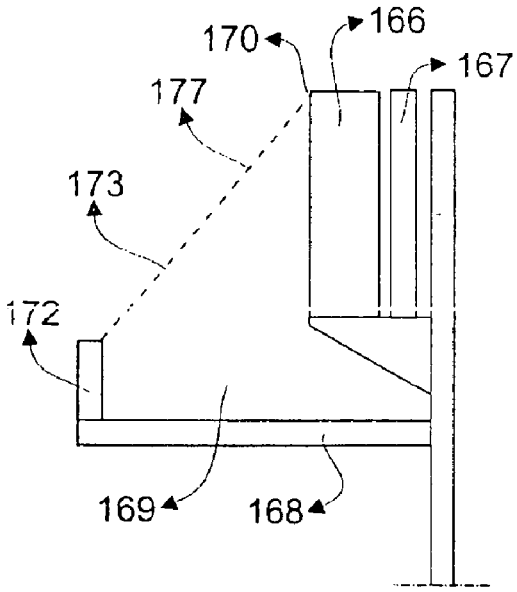
FIG. 29 shows, diagrammatically, a stationary collision element with a height-adjustable annular plate on which an autogenous bed of its own crushed material is able to build up.
Figure 30:
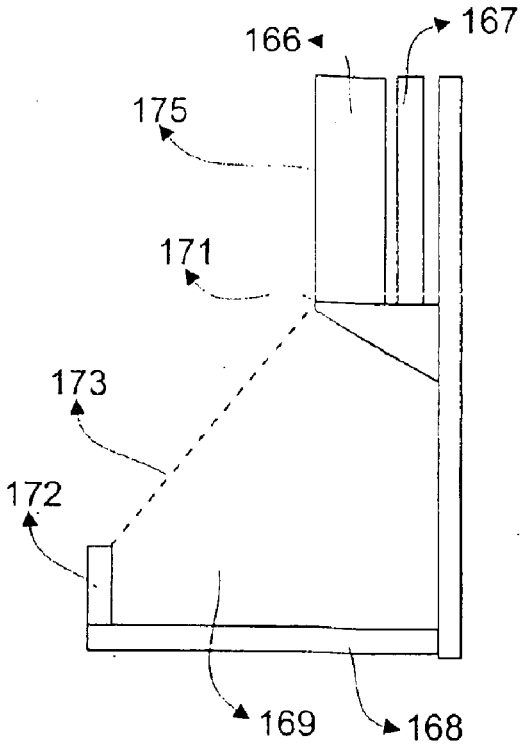
FIG. 30 shows, diagrammatically, a stationary collision member with a height-adjustable annular plate on which an autogenous bed of its own crushed material is able to build up.

FIGS. 29 and 30 show, diagrammatically, a stationary collision member (166) that is constructed as a single ring element with a protective ring (167), under which ring element (166) an annular plate (168) is arranged on which an autogenous bed of crushed material is able to build up in the collection chamber (169); the height of which annular plate (168) is adjustable, by which means it is also possible to adjust the height of the upper edge (170→171). The annular plate (168) is provided with an upright plate edge (172), against which the bed of crushed material (173) is able to build up.

With the aid of constructions as indicated in FIGS. 27 to 30 it is possible to allow the material to strike a collision surface (174) (175), an autogenous bed of crushed material (176) (177) or partly the collision surface (174) (175) and partly the autogenous bed (176) (177).

The rotor (93) is provided with an accelerator unit by means of which the material is accelerated and propelled outwards. The method and the device of the invention provide a possibility for constructing the accelerator unit in the form of:

at least one acceleration member that is provided with at least one acceleration surface, that extends in the radial or tangential direction and acts as accelerator surface at least one guide member that is provided with at least one guide surface that acts as first accelerator surface and a (synchronised) impact member that is associated with said guide members and is provided with an impact surface that acts as second accelerator surface; which embodiment is preferred;

a guide member that is provided with at least one guide surface that acts as first accelerator surface, a (synchronised) first impact member that is associated with said guide member and is provided with a first impact surface that acts as second accelerator surface and a (synchronised) second impact Member that is associated with said first impact member and is provided with a second acceleration surface that acts as a third accelerator surface.

These embodiments are further discussed here. For the method and device of the invention it is preferable if the material is propelled outwards from the rotor at as large as possible a take-off angle ($\alpha$), or with as great as possible radiality; so that the distance between the outer edge of the rotor and the collision surface can be chosen as small as possible.

Figure 31:
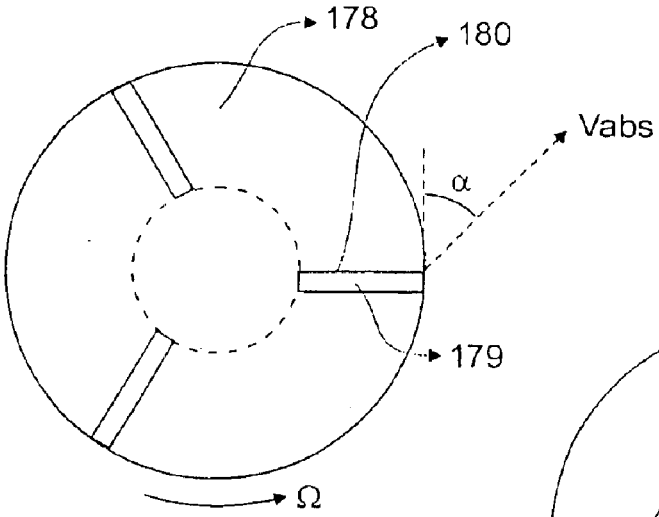
FIG. 31 shows, diagrammatically, a first practical rotor.

FIG. 31 shows, diagrammatically, a first practical rotor (178), the accelerator unit of which is constituted by an acceleration member (179) that is provided with a radially oriented guide surface (180). As already indicated (FIGS. 3 and 4), such an embodiment yields the highest possible (achievable) take-off velocity (Vabs), but the take-off angle remains restricted to at most 45°; as a result of friction along the guide surface (180), the transverse: (Vt) velocity component usually predominates, as a result of which the take-off angle ($\alpha$) remains restricted to approximately 40°.

Figure 32:
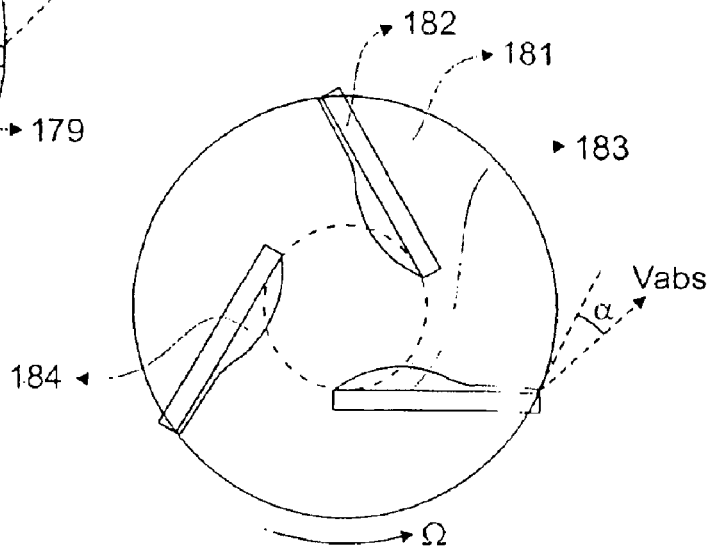
FIG. 32 shows, diagrammatically, a second practical rotor.

FIG. 32 shows, diagrammatically, a second practical rotor (181) in which the accelerator unit is constituted by an acceleration member (192) that is provided with a tangentially oriented acceleration surface (183); on which an autogenous bed (184) of the material itself settles, which acts as acceleration surface, What is achieved in this way is that wear is restricted; as has been indicated in FIGS. 5 and 6, the take-off angle ($\alpha$) is, however, small because the transverse (Vt) velocity component is highly predominant.

Figure 33:
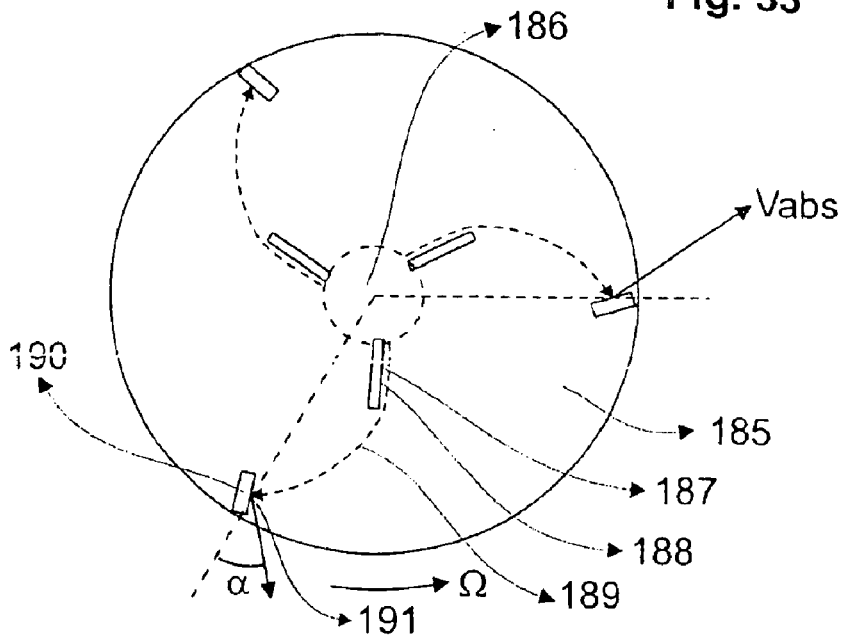
FIG. 33 shows, diagrammatically, a third practical rotor.

FIG. 33 shows, diagrammatically, a third practical rotor (185) where three guide members are arranged (187) here around the central section (186), the guide surfaces (188) of which guide members are here oriented backwards; it is) of course, possible to install a greater or smaller number of guide members and to position these in a different way. With the aid of the guide member (187) the material is guided in a spiral stream (189) that is oriented backwards (viewed from a standpoint co-rotating with said guide member (187)) towards a co-rotating impact member (190) that is equipped with an impact surface (191) that is essentially oriented transversely to said spiral stream (189). What is achieved with such a combination is that the take-off angle ($\alpha$) increases to 45°–50° and even more, as a result of which the radiality of the injection stream (192) increases substantially. Such an embodiment is therefore preferred.

Figure 34:
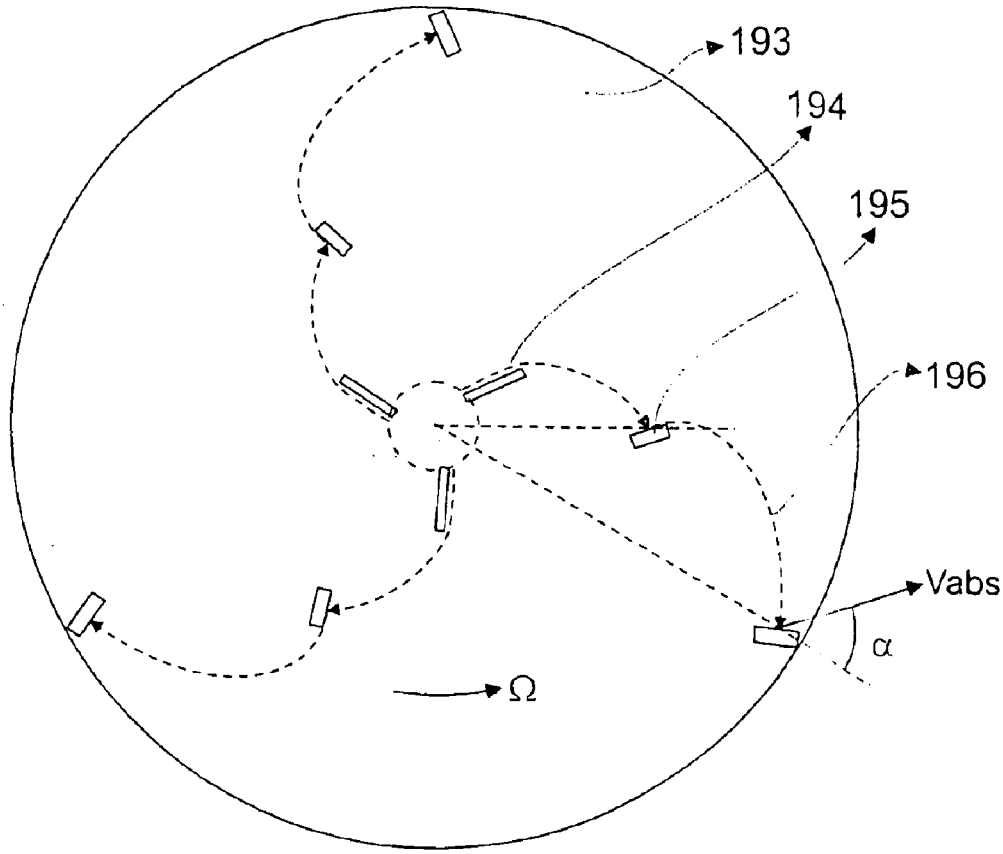
FIG. 34 shows, diagrammatically, a forth practical rotor.

FIG. 34 shows, diagrammatically, a fourth practical rotor (193) with which the acceleration unit is constituted by a guide member (194), a first co-rotating impact member (195) and a second co-rotating impact member (196). Such a configuration makes it possible to allow the take-off angle ($\alpha$) to increase to more than 50°.

Figure 35:
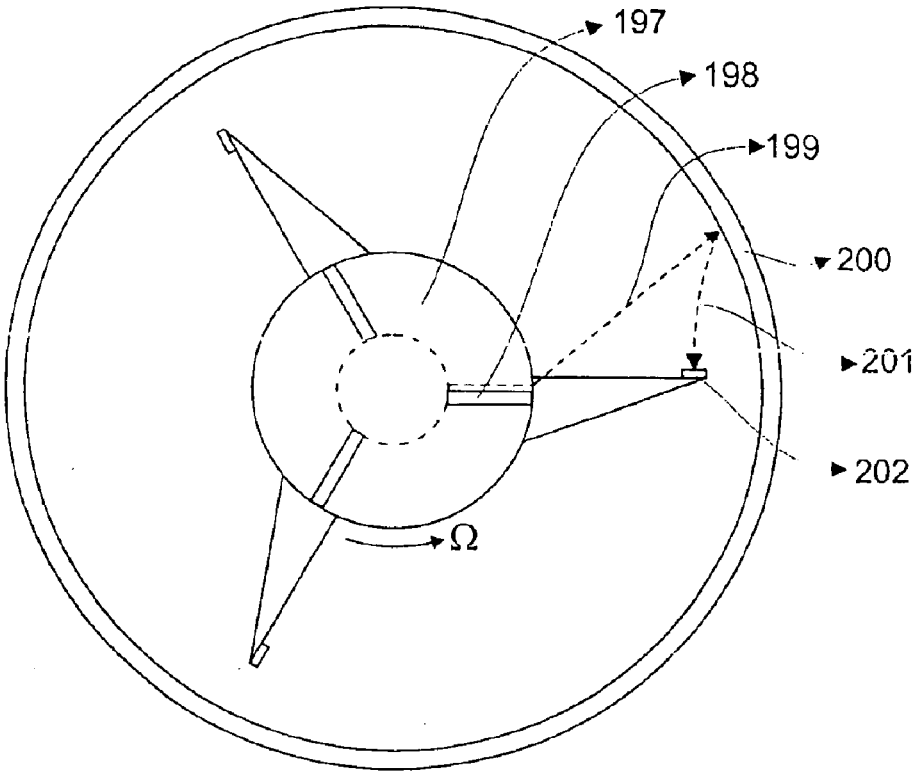
FIG. 35 shows, diagrammatically, a fifth practical rotor.

FIG. 35 shows, diagrammatically, a fifth practical rotor (197) with which the material is propelled outwards from an acceleration member (198). The material then moves along an ejection stream (199), after which It strikes the collision ring member (200); after which it rebounds and is guided in a spiral stream (201) that is oriented backwards, after which it strikes an impingement member (202) that is carried by said rotor (197).

Figure 36:
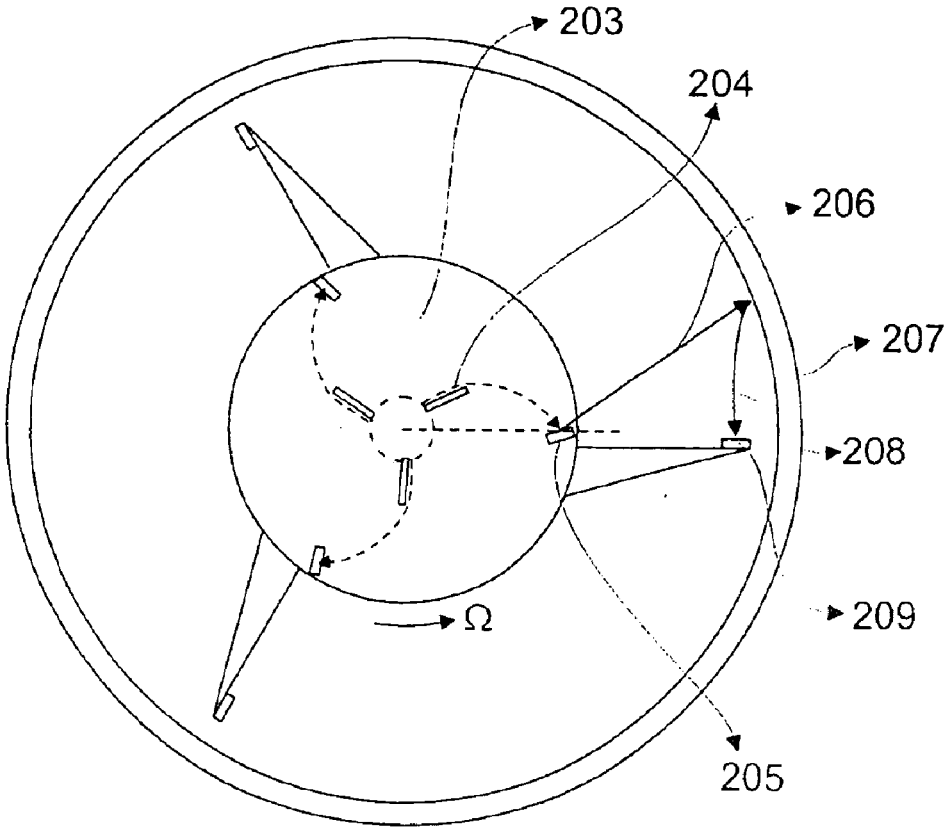
FIG. 36 shows, diagrammatically, a sixth practical rotor.

FIG. 36 shows, diagrammatically, a sixth practical rotor (203) with which the material is guided from a guide member (204) to an impact member (205) that is carried by said rotor (203), from where the material is guided into the ejection stream (206), the material strikes the collision ring member (207), rebounds therefrom and is guided in a spiral stream (208) that is oriented backwards, after which it strikes an impingement member (209) that is carried by said rotor (203).

Figure 37:
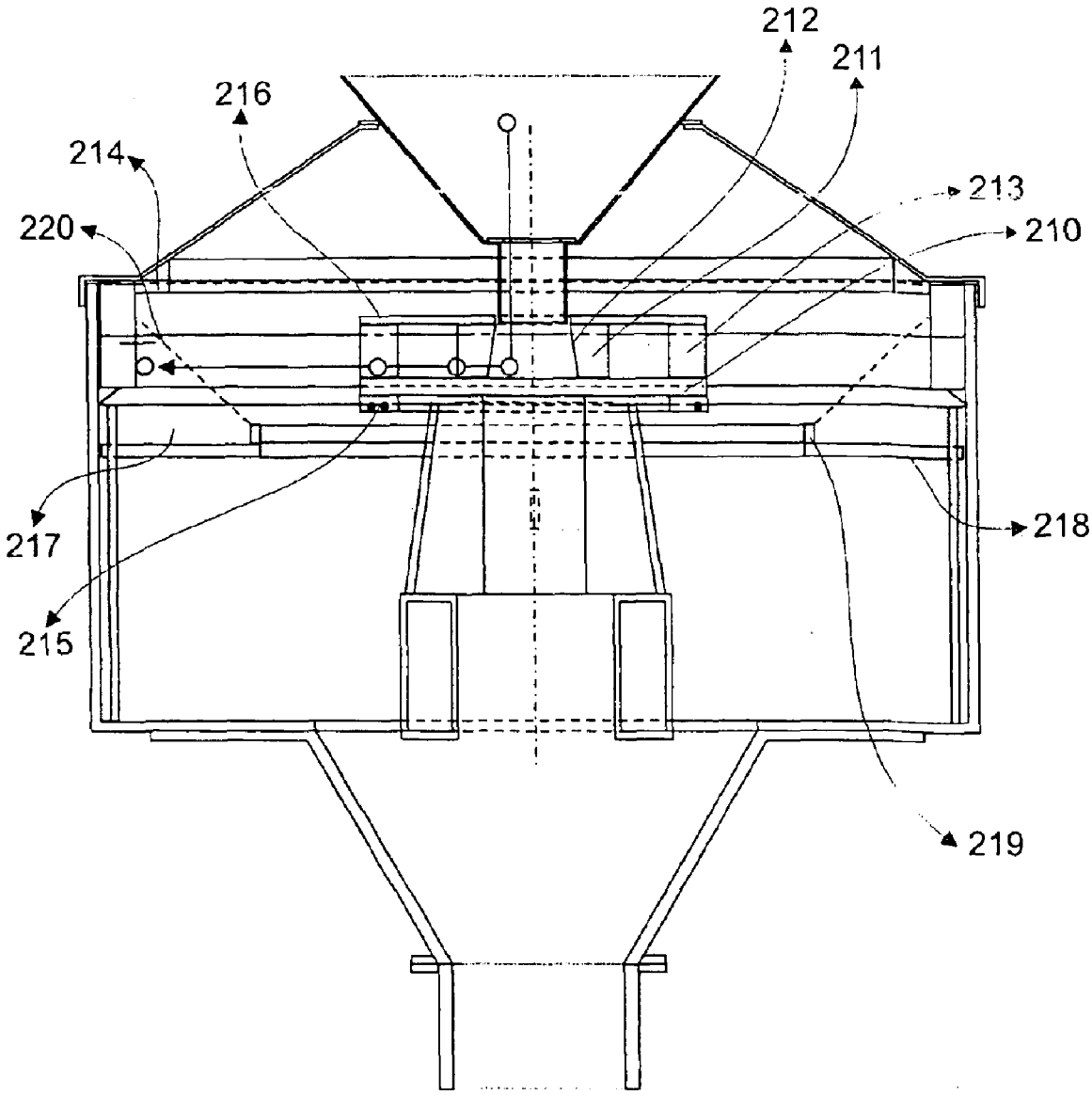
FIG. 37 shows, diagrammatically, a cross-section of a second basic device according to the method of the invention.

FIG. 37 shows, diagrammatically, a cross-section of an embodiment according to the method and device of the invention with which the rotor (210) is equipped with guide members (211), the inside edge (212) of which is oriented outwards and obliquely downwards, and with (synchronised) co-rotating impact members (213) associated with said guide members (211). The crusher is equipped with a collar member (214) for collecting material that spatters upwards. Because wear can then ace place all round, or at least distributed along the impact surface, imbalance can arise as a result of the adjustment in said surfaces, The method and device of the invention therefore provides a possibility for providing the rotor with an auto-balancing device (215)(216) which here is fixed to the rotor top and bottom (but can also consist of a single ring) and consists of a circular tubular track, which can be made of round, circular or rectangular cross-section, in which tubular track a number of balls (or flat discs) are able to move freely; for this purpose the tubular track must be (approximately 75%) filled with a fluid, preferably oily fluid. The balls or discs can be made of steel) hard metal or ceramic, It is, of course, also possible to position the auto-balancing device elsewhere. Here the collection chamber (217) underneath the collision member builds up on a circular plate (218) that is provided with an upright plate edge (219) on which an autogenous bed (220) of the material itself forms. The height of the annular plate (218) is adjustable.

Figure 38:
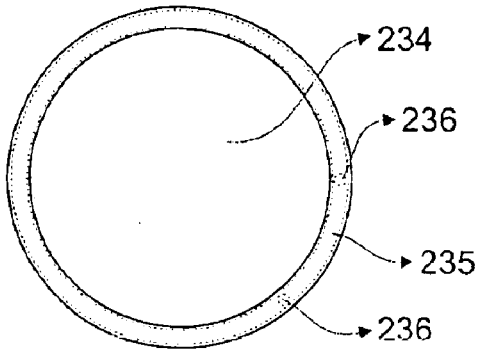
FIG. 38 shows, diagrammatically, a rotor equipped with a hollow balancing ring.
Figure 39:
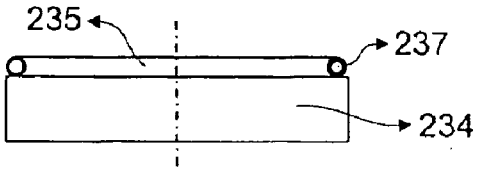
FIG. 39 shows, diagrammatically, a rotor equipped with a hollow balancing ring.

FIGS. 38 and 39 show, diagrammatically, a rotor (234) that is equipped with a hollow balancing ring (235) which is positioned on top of the rotor (234) and is partially filled with oil, usually approximately 75% filled, and contains at least two solid bodies (236), in the form of balls or discs, for balancing said rotor (234). The hollow space (237) in the balancing ring (235) is circular here.

Figure 40:
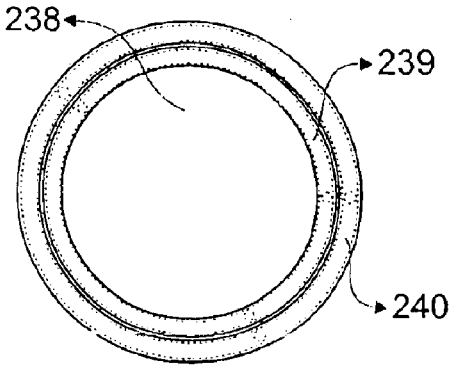
FIG. 40 shows, diagrammatically, a rotor equipped with two hollow balancing rings.
Figure 41:
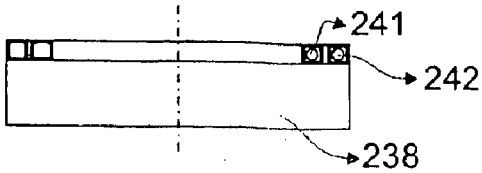
FIG. 41 shows, diagrammatically, a rotor equipped with two hollow balancing rings.

FIGS. 40 and 41 show a situation similar to that in FIGS. 38 and 39, the rotor (238) being equipped with two balancing rings (239)(240) which are positioned alongside one another on top of the rotor (238). The hollow space (241) (242) in the balancing rings (239)(240) is rectangular (square) here.

Figure 42:
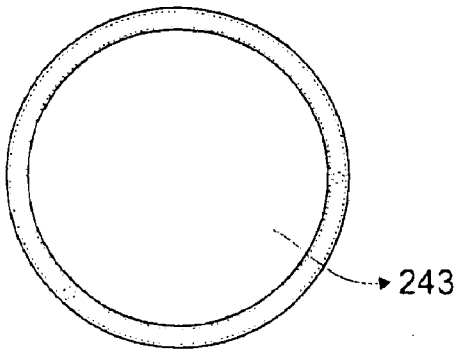
FIG. 42 shows, diagrammatically, a rotor equipped with two hollow balancing rings.
Figure 43:
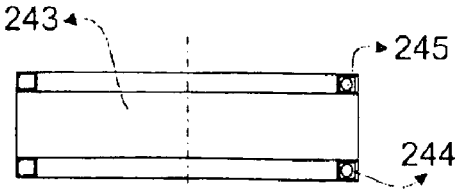
FIG. 43 shows, diagrammatically, a rotor equipped with two hollow balancing rings.

FIGS. 42 and 43 show a situation similar to that in FIGS. 38 and 39, the rotor (243) being equipped with two balancing rings (244)(245); one balancing ring (245) on top of the rotor (243) and one balancing ring (244) in contact with the rotor (243) at the bottom.

Figure 44:
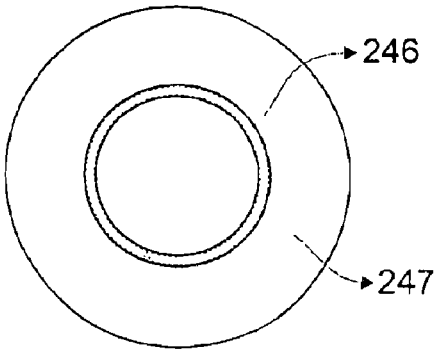
FIG. 44 rows, diagrammatically, a smaller balancing ring.
Figure 45:
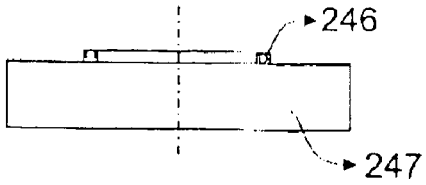
FIG. 45 shows, diagrammatically, a smaller balancing ring.

FIGS. 44 and 45 show, diagrammatically, a balancing ring (246) which has a smaller diameter than the rotor (247) and is positioned concentrically on top of the rotor (247).

The degree of imbalance that can be balanced with the aid of these balancing rings increases with the diameter of the ring, the diameter of the cross-section of the ring anti the diameter, the number and the weight of the solid bodies.

Figure 46:
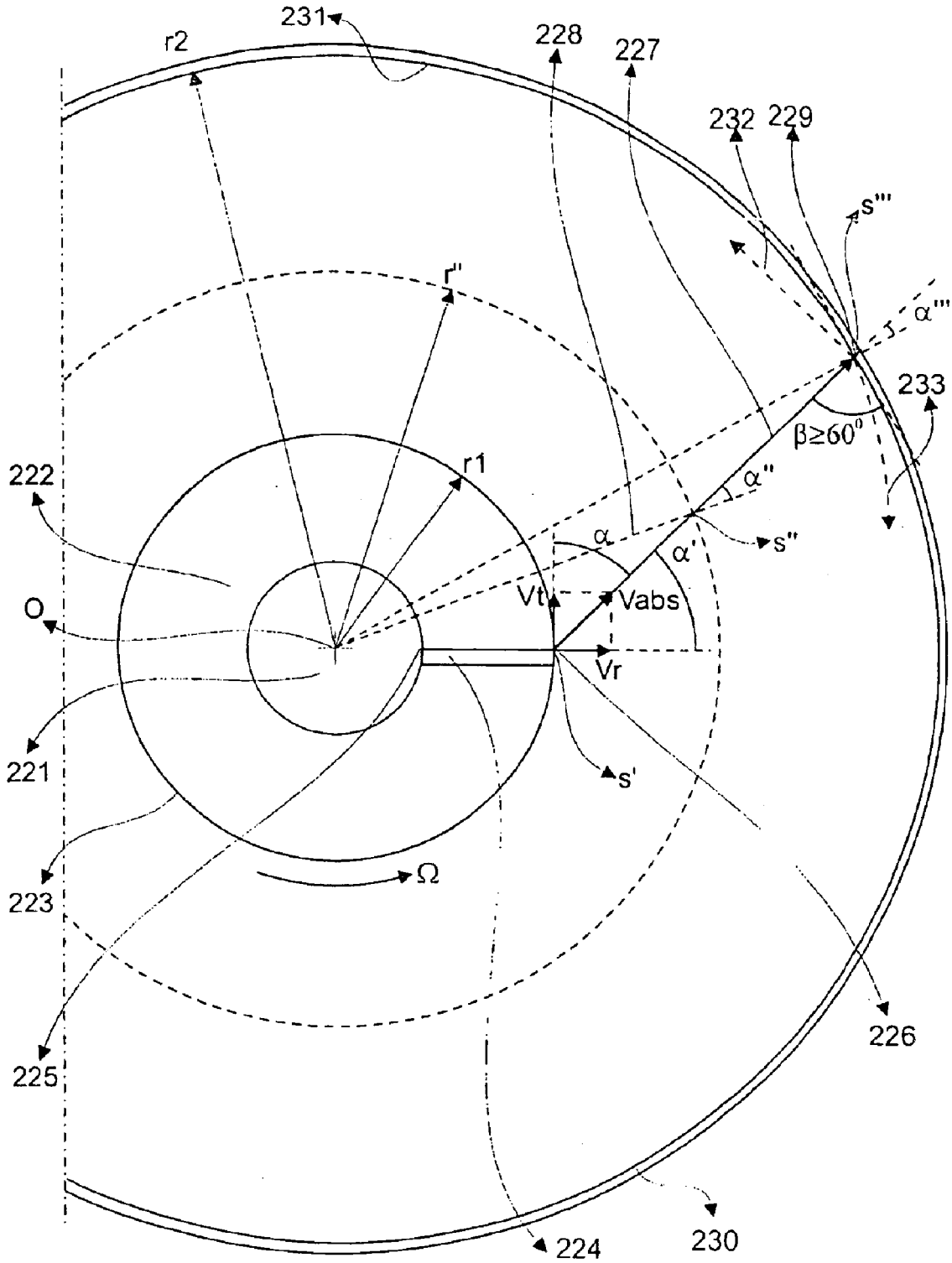
FIG. 46 shows, diagrammatically, a method for causing a stream of granular material to collide in an essentially deterministic manner.

FIG. 46 shows, diagrammatically, a method for causing a stream of granular material to collide in an essentially deterministic manner, for loading said material in such a way that said material is comminuted in an essentially predetermined manner with the aid of at least one collision member, comprising:

metering said material through an inlet (not indicated here) onto a metering location (221) that is located close to a vertical axis of rotation (O) of a rotor (222), that can be rotated (Ω) in at least one direction about said axis of rotation (O), which metered material moves from said metering location (221) towards the outer edge (223) of said rotor (222);

causing said material that has been moved to accelerate with the aid of an accelerator unit (224) that is carried by said rotor (222) and is located a radial distance away from said axis of rotation (O) that is greater than the corresponding radial distance to said metering location (221) and consists of at least one accelerator member (224) (indicated here as an acceleration member, but the accelerator unit can be made up in several ways, as has been indicated above), which accelerator unit (224) extends from a feed location (225) towards a take-off location (226) that is located a greater radial distance away from said axis of rotation (O) than is said feed location (225), said material at said feed location (225) being picked up by said accelerator unit (224) and being accelerated with the aid of said accelerator unit (224), after which said accelerated material, when it leaves said accelerator unit (224) at said takeoff location (226), is propelled outwards from said accelerator unit (224) at an absolute take-off velocity (Vabs) which is made up of a radial (Vr) and a transverse (Vt) velocity component, at an essentially predetermined take-off angle (α) along a straight ejection stream (227) that is oriented forwards, the magnitude of which take-off angle (α) is determined by the magnitudes of said radial (Vr) and transverse (Vt) velocity components, viewed in the plane of rotation, viewed from said axis of rotation (O), viewed in the direction of rotation (Ω) and viewed from a stationary standpoint;

causing said accelerated material to move along said straight ejection stream (227) which in the apparent sense extends in an increasingly more radial direction as said material moves further away from said axis of rotation (O), which straight ejection stream (227) describes an apparent angle of movement (α") between the straight ejection line (227) that is determined by said straight ejection stream (227) and the radial line from said axis of rotation (228) that intersects this straight ejection stream (227) at a point of intersection (s") at a location along said straight ejection line (227), which apparent angle of movement (α") changes between said take-off location (226) and the stationary collision location (229) where said material impinges on said stationary collision member (230), and specifically from a first angle of movement (α'") at the location where said point of intersection (s') is coincident with said take-off location (226) to a final apparent angle of movement (α'") at the location where said point of intersection (s'") is coincident with said collision location (229), said apparent angle of movement (α") being smaller than said first angle of movement (α'), greater than said final apparent angle of movement (α'") and becoming increasingly smaller as the radial intermediate distance (r") from said axis of rotation (O) to said point of intersection (s") increases compared with the first radial distance (r1) from said axis of rotation (O) to the take-off location (226), viewed in the plane of rotation, viewed from said axis of rotation (O), viewed in the direction of rotation (Ω) and viewed from a stationary standpoint;

causing said material that moves along said ejection stream (227) to collide in an essentially deterministic mariner at an essentially predetermined stationary collision location (229) and at an essentially predetermined collision velocity (Vabs) with the aid of at least one stationary collision member (230) that is arranged around said rotor (222) a radial distance away from said axis of rotation (O) that is greater than the corresponding radial distance to said outer edge (223) of said rotor (222), which collision member (230) is provided along the inside with at least one collision surface (231) that essentially is in the form of a solid of revolution, the axis of revolution of which is coincident with said axis of rotation (O), at least a central section (not indicated here) of which collision surface (231) is oriented essentially transversely to said straight ejection stream (227), the second radial distance (r2) from said axis of rotation (O) to said collision location (229) in relation to said corresponding first radial distance (r1)—i.e. the ratio (r2/r1)—being chosen at least sufficiently large that said material impinges on said collision surface (231) in an essentially deterministic manner at an essentially predetermined collision angle (β), which is sufficiently large that said material is sufficiently loaded during the collision—but at least equal to or greater than 60°—which ratio (r2/r1) is determined by the magnitude of said take-off angle (α), and which collision angle (β) is essentially determined by said final apparent angle of movement (α'"), said material being guided, when it leaves said collision location (229), into a first straight movement path (232) that is oriented forwards, viewed in the plane of rotation, viewed in the direction of rotation (Ω), viewed from said axis of rotation (O) and viewed from a stationary standpoint, and is guided into a spiral movement path (233) that is oriented backwards, viewed in the plane of rotation, viewed in the direction of rotation (Ω), viewed from said axis of rotation (O) and viewed from a standpoint co-rotating with said accelerator unit (224).

Figure 47:
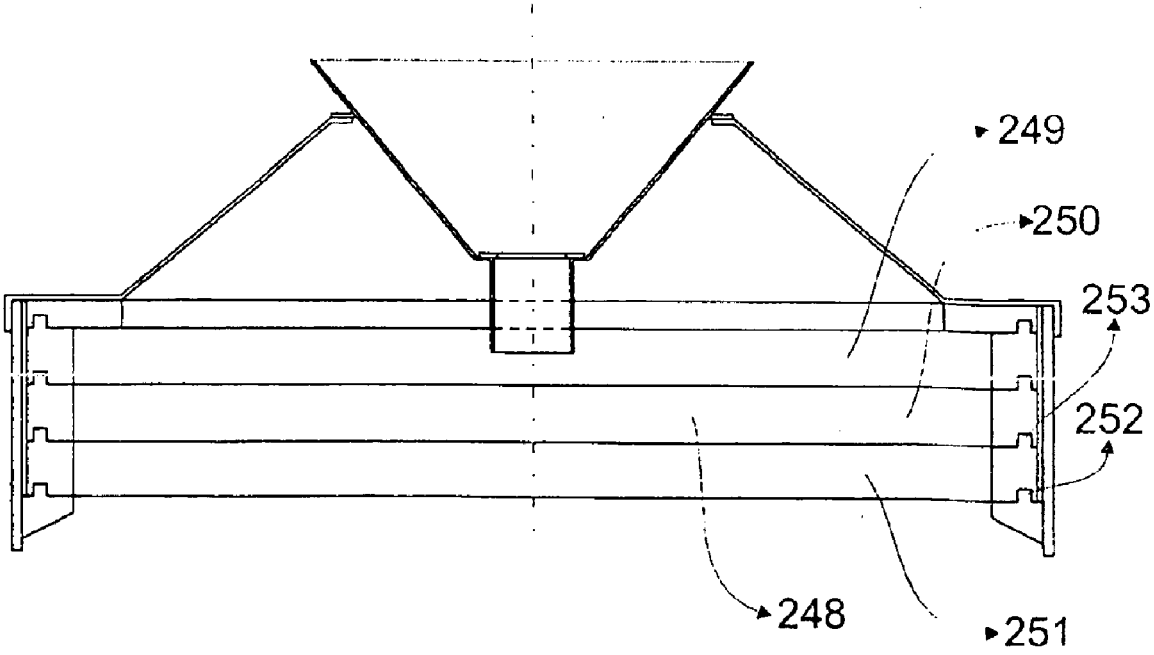
FIG. 47 shows, diagrammatically, a first practical embodiment of the annular collision member.

FIG. 47 shows, diagrammatically, a first practical embodiment of the annular collision member Here the annular collision member (248) is constructed as an annular collision ring member with three collision rings (249)(250)(251) placed on top of one another, Each of the collision rings (249)(250)(251) is provided on the bottom with a slot or groove (252) and on the top with an upright rim (253) that fits in said groove (252). In this way the collision rings (249)(250)(251) can be stacked on top of one another, what is achieved by this means being that the collision rings (249)(250)(251) are centred well with respect to one another and in the event of breakage of one of the collision rings (249)(250)(251) it is here less easy for a piece of ring to fall out. The invention provides the possibility that the collision rings are joined cold to one another in some other way or are hooked into one another (not shown here).

Figure 48:
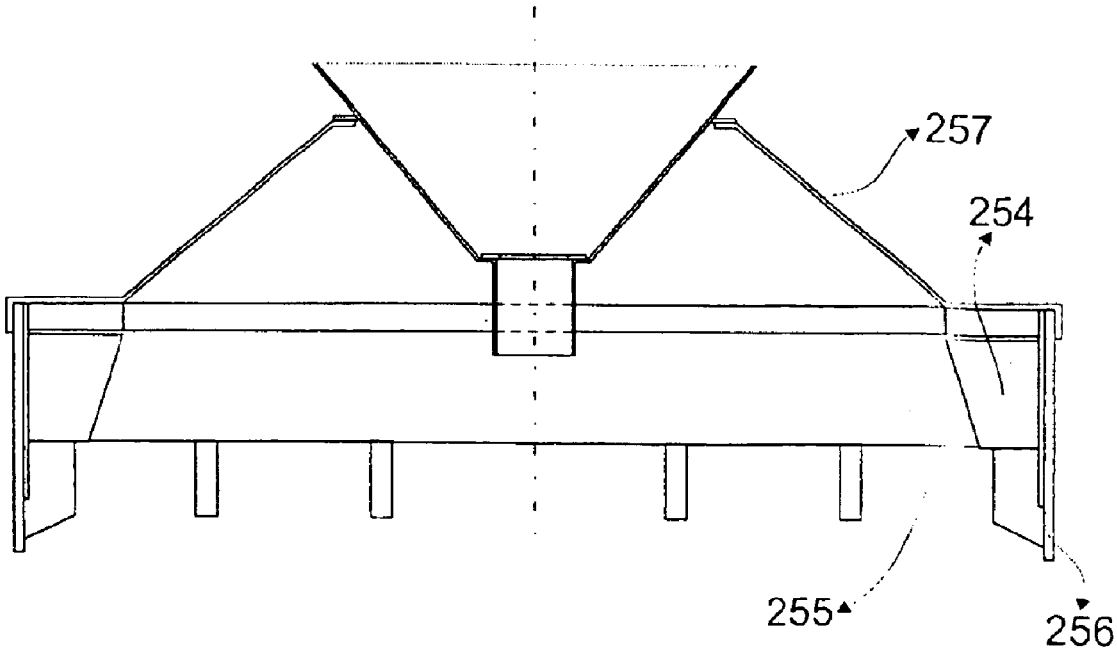
FIG. 48 shows, diagrammatically, a second practical embodiment of the annular collision member.

FIG. 48 shows, diagrammatically, a second practical embodiment of the annular collision member. Here the annular collision member (254) is constructed in the form of a single collision ring, the collision surface (255) of which describes a truncated cone shape widening towards the bottom This has the advantage that during collision the material is deflected in a downward direction, what is achieved by this means being that the material impinges at a higher velocity on the autogenous bed (not shown here) that is able to form against the crusher wall (256) below the annular collision member (254); and at the same time prevents that less material rebounds upwards after the impact and damages the lid (257) of the crusher house (256).

Figure 49:
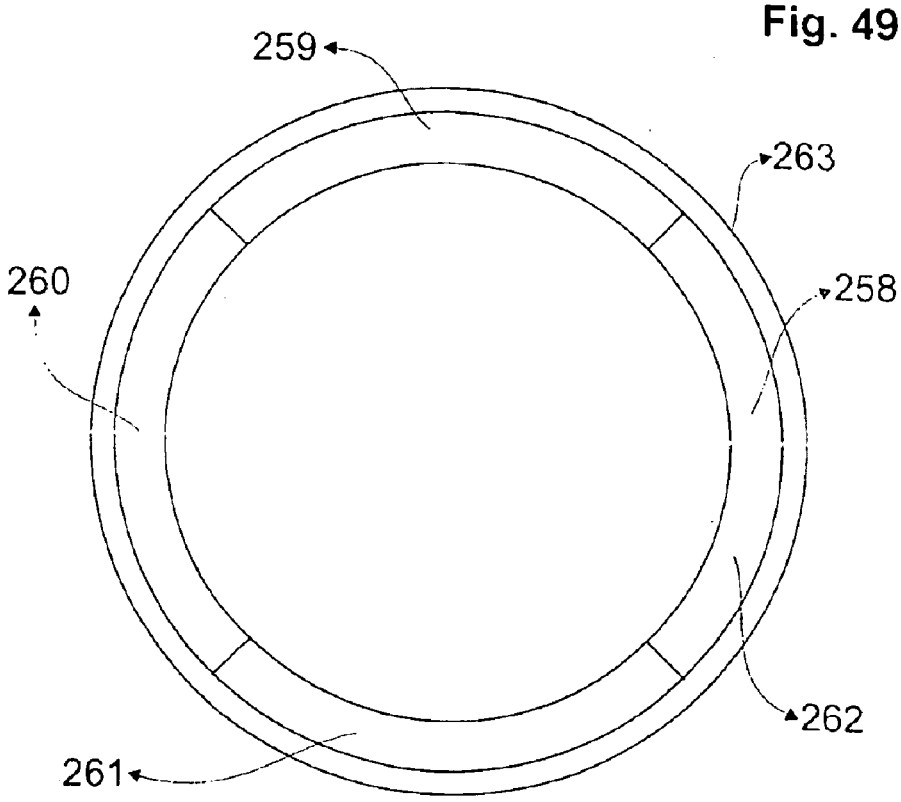
FIG. 49 shows, diagrammatically, a third practical embodiment of the annular collision member.

FIG. 49 shows, diagrammatically, a third practical embodiment of the annular collision member. Here the annular collision member (258) is constructed in the form of a collision ring member that is made up of a collision ring that consists of four separate elements (259)(260)(261)(262) that abut one another cold and as a whole form a collision ling. It is preferable to place the elements (259)(260)(261)(262) of such a collision ring member (258) in a holder (263), which holder can be removed together with the collision ring elements. What is achieved in this way is that the collision rings are firmly enclosed and replacement of the collision ring elements (259)(260)(261)(262) can take place outside the crusher housing.

Figure 50:
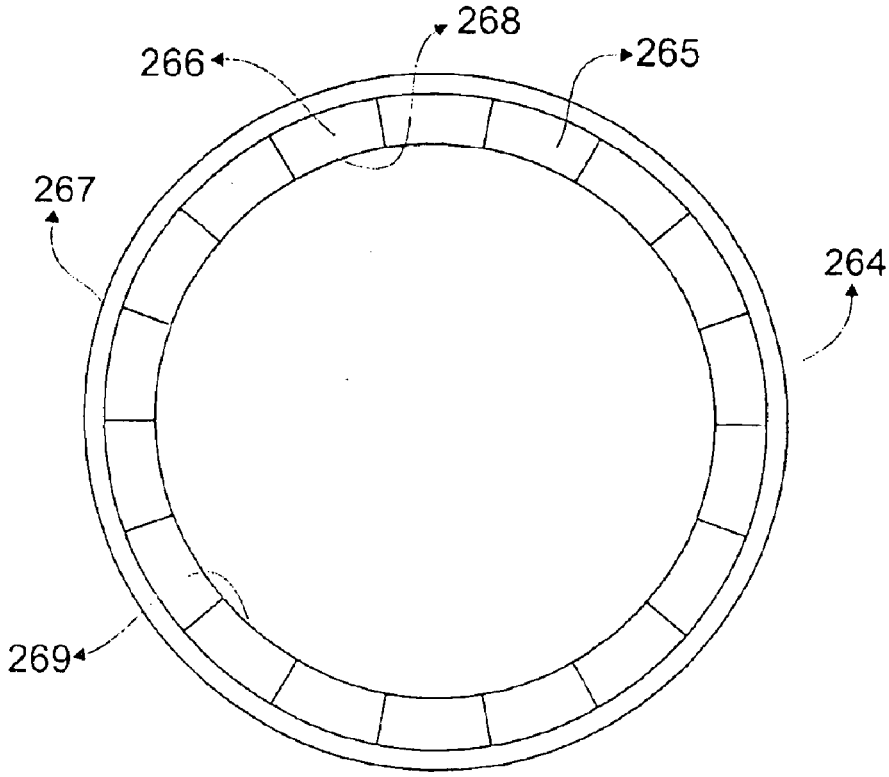
FIG. 50 shows, diagrammatically, a fourth practical embodiment of the annular collision member.

FIG. 50 shows, diagrammatically, a fourth practical embodiment of the annular collision member. Here the annular collision member (264) is made up of a collision ring member (265) that is made up of multiple collision ring elements (266) which have been placed in a holder (267), which can be removed together with the collision ling member. Such a construction has the advantage that the individual collision ring elements (266) are more lightweight and consequently more easy to handle. Here the individual collision ring elements (266) are constructed with a rounded collision surface (268) so that as a whole (269) a smooth annular collision surface is formed.

Figure 51:
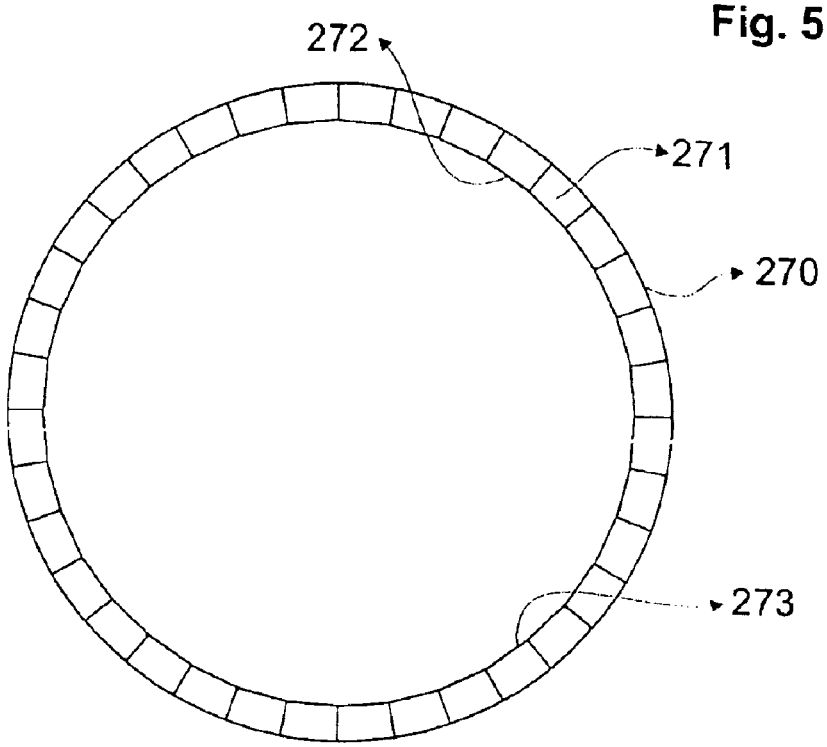
FIG. 51 shows, diagrammatically, a fifth practical embodiment of the annular collision member.

FIG. 51 shows, diagrammatically, a fifth practical embodiment of the annular collision member. Here the annular collision member (270) is made up of a collision ring member consisting of several collision ring elements (271). These collision ring elements (271) have a straight collision surface (272), as a result of which an annular collision surface (273) in the form of a regular polygon is obtained. Once in use a more cylindrically shaped annular collision surface rapidly forms as a result of wear. Here the individual collision ring elements (271) are so constructed that they abut one another at their sides.

Figure 52:
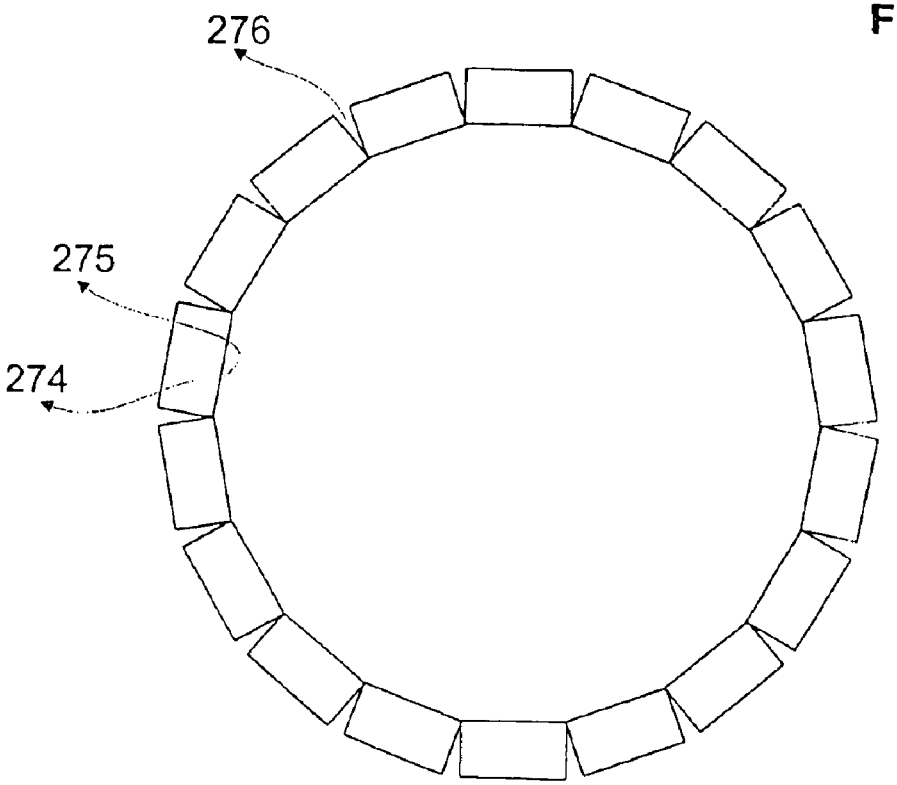
FIG. 52 shows, diagrammatically, a sixth practical embodiment of the annular collision member.

FIG. 52 shows, diagrammatically, a sixth practical embodiment of the annular collision member. Here the individual collision ring elements (274) are of rectangular construction with a straight collision surface (275). As the collision ring elements wear a more cylindrical collision surface is produced, in which, however, vertical slits (276) form between the collision ring elements (274). However, these slits fill with the material itself so that as a whole, partly under the influence of wear, a more cylindrical collision surface is nevertheless formed.

Figure 53:
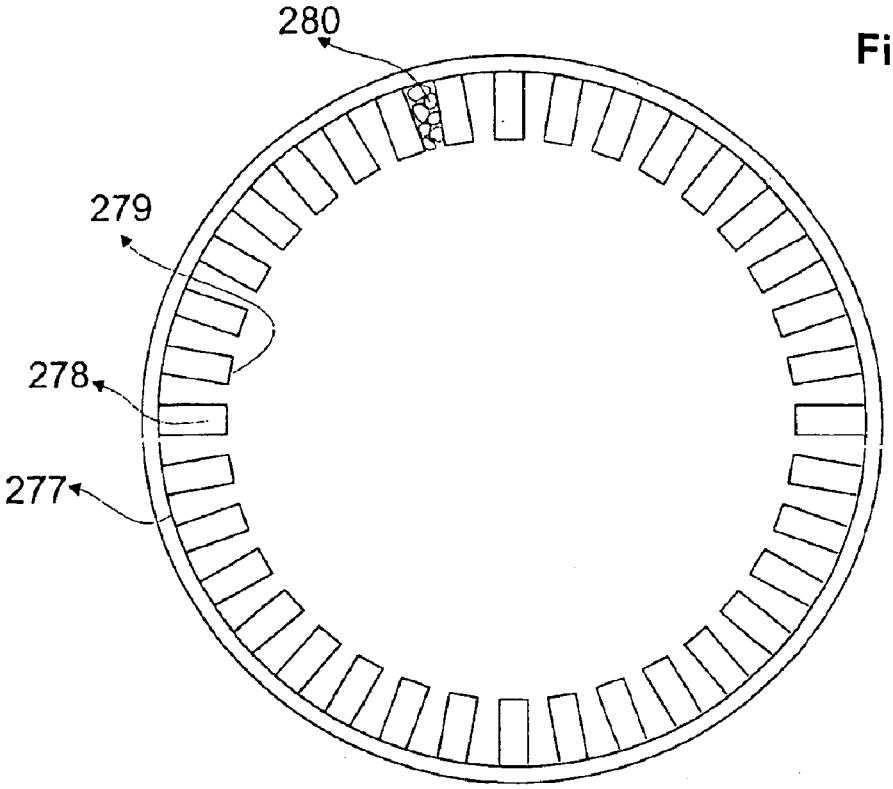
FIG. 53 shows, diagrammatically, a seventh practical embodiment of the annular collision member.

FIG. 53 shows, diagrammatically, a seventh practical embodiment of the annular collision member. Here the collision ring member (277) is constituted by collision plates (278) that are positioned alongside one another some distance apart, in such a way that the collision surfaces (279) of the collision plates (278) form a sort of open regular polygon, the material itself settling in the openings (slits (280)) between the collision plates (278) so that the material strikes partially on metal collision surfaces (279) and partially on collision surfaces of the material itself (280). The collision plates (278) are fixed in a holder (281) that can be removed together with the collision plates. This type of construction makes it possible to save a third and up to half of wear material, without the effectiveness of the annular collision member being appreciably reduced.

Figure 54:
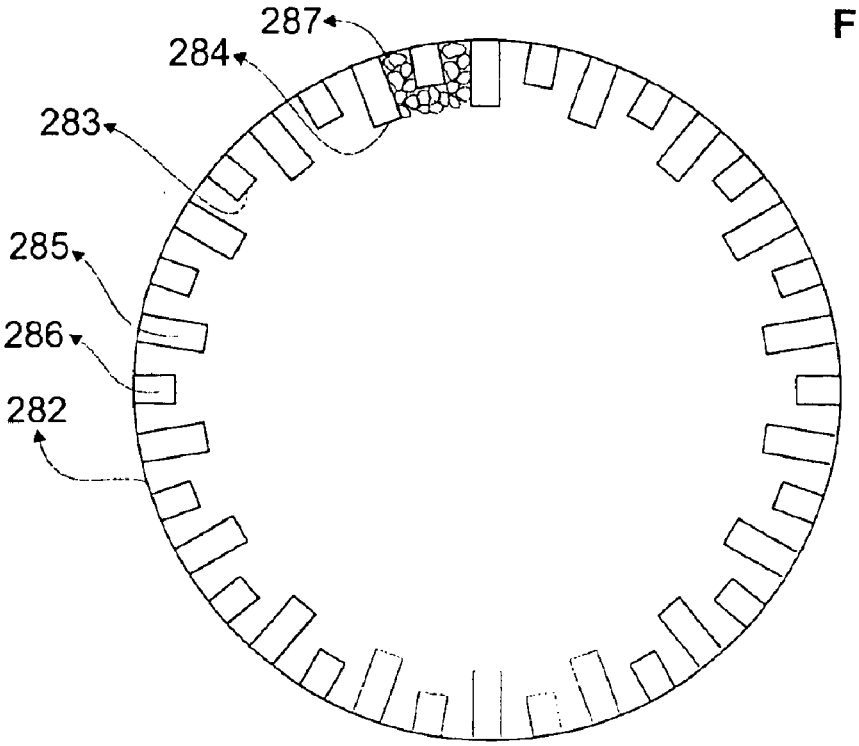
FIG. 54 shows, diagrammatically, an eighth practical embodiment of the annular collision member.

FIG. 54 shows, diagrammatically, an eighth practical embodiment of the annular collision member. Here the collision ring member (282) is essentially identical to the seventh practical embodiment of the annular collision member (FIG. 53), the collision surfaces (283)(284) of the collision plates (295)(286) located alongside one another being offset. As a result more of the material itself (287) is able to settle between the collision plates (285)(286), pith the result that a larger proportion of the material strikes the material itself (287). Such an embodiment is even less expensive and particularly effective in the case of less hard material.

Figure 55:
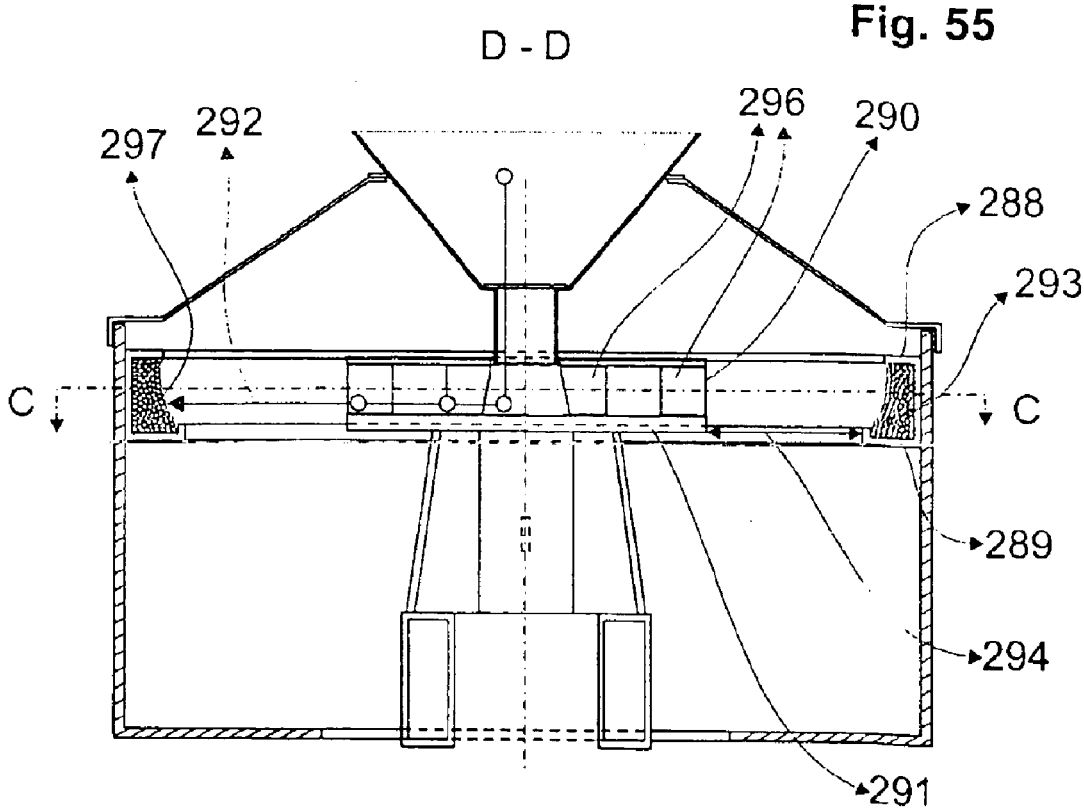
FIG. 55 shows, diagrammatically, a ninth practical embodiment of the annular collision member.

FIG. 55 shows, diagrammatically, a ninth practical embodiment of the annular collision member. Here the annular collision member (288) is constructed in the form of an annular channel construction (289) that is arranged centrally around the rotor (291) with the opening (290) facing inwards, said opening (290) being oriented essentially transversely to said ejection stream (292) An autogenous bed of crushed material (293), which forms an annular collision member, forms in the channel construction. As a result of the large free radial distance (294) between the outer edge (295) of of the acceleration unit (296) and the autogenous annular collision surface (297) the material impinges at a fairly large angle, at least greater than 60° and preferably greater than 70°, what is achieved by this means being that the comminution intensity increases compared with conventional autogenous crushers where the annular collision surface is a much smaller distance away from the rotor and the material impinges on the autogenous annular collision surface at a much smaller angle, usually less than 30°–40° (and even smaller), as a result of which the material shoots past and is guided at high velocity along the autogenous annular collision surface, as a result of which the comminution intensity is limited; which is also often the intention because the material only has to be rendered cubic.

What is achieved by arranging the annular autogenous collision surface (297) a greater distance away from the rotor is that the material breaks up more during impact on the annular autogenous collision surface (297). From the autogenous annular collision member (288) the material can still be guided into a bed of autogenous material that can build up below the autogenous annular collision member (288) on the outside wall of the crusher (not shown here), where further cubic shaping can take place.

Figure 56:
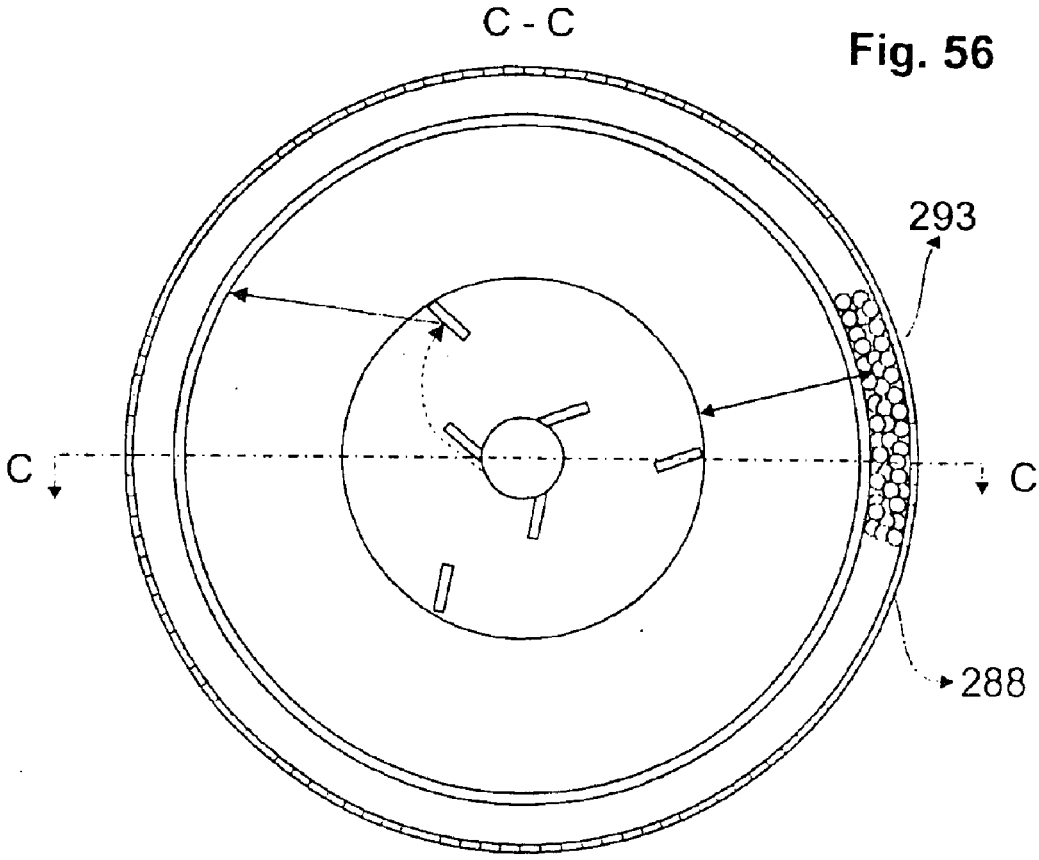
FIG. 56, finally, shows the autogenous annular collision member of the ninth practical embodiment.

FIG. 56 finally, shows the autogenous annular collision member (288) of the ninth practical embodiment (FIG. 55) diagrammatically in cross-section.

The above descriptions of specific embodiments of the present invention are given with a view to illustrative and descriptive purposes. They are not intended to be an exhaustive list or to restrict the invention to the precise forms given, and having due regard for the above explanation, many modifications and variations are, of course, possible The embodiments have been selected and described in order to describe the principles of the invention and the practical application possibilities thereof in the best possible way in order thus to enable others skilled in the art to make use in an optimum manner of the invention and the diverse embodiments with the various modifications suitable for the specific intended use. The intention is that the scope of the invention is defined by the appended claims according to reading and interpretation in accordance with generally accepted legal principles, such as the principle of equivalents and the revision of components.

What is claimed is:

1. Method for causing material to be crushed to collide at least once, in an essentially deterministic manner, with the aid of a: least one collision member, comprising:

metering said material onto a rotor (222) that can be rotated (Ω) about a vertical axis of rotation (O), which metering takes place. With the aid of a metering member at a metering location (221) close to said axis of rotation (O), which metered material moves outwards from said metering location (221) towards the outer edge (223) of said rotor (222) under the influence of the rotary movement of said rotor (222);

causing said metered material to accelerate, in at least one step, with the aid of an accelerator unit (224), which accelerator unit is carried by said rotor and consists of at least one guide member that is provided with at least one guide surface that extends towards said outer edge of said rotor, which accelerated material leaves said accelerator unit at a take-off location and is propelled outwards from said rotor along an ejection stream, which take-off location is located a first radial distance (r1) from said axis of rotation, said accelerated material moving along said ejection stream in an increasingly more radial direction from said axis of rotation as said material moves further away from said axis of rotation, viewed from a stationary standpoint;

causing said material that moves along said ejection stream (227) to collide, in an essentially deterministic manner, with the aid of said collision member, which is provided with at least one annular collision surface that is oriented essentially transversely to said ejection stream and is arranged centrally around said rotor, which annular collision surface is located a second radial distance (r2) away from said vertical axis of rotation which is greater than the corresponding radial distance to said outer edge of said rotor, after which said material, when it leaves said collision member, moves further along a movement path;

wherein, said second radial distance (r2) from said vertical axis of rotation to said annular collision surface in relation to said first radial distance (r1) from said axis of rotation to said take-off location, the ratio r2/r1, is chosen at least so large that said material moving along said ejection stream impinges on said annular collision surface at an angle that is equal to or greater than 60°, viewed from a stationary standpoint, the ratio r2/r1 being at least equal to or greater than 1.50.

2. Method according to claim 1, wherein said take-off location is located a radial distance away from said axis of rotation that is equal to the corresponding radial distance to the outer edge of said rotor.

3. Method according to claim 1, wherein said take-off location is located a radial distance away from said axis of rotation that is equal to the corresponding radial distance to the outer edge of said accelerator unit.

4. Method according to claim 1, wherein said annular collision surf ace describes a surface of revolution, the axis of revolution of which is coincident with said axis of rotation.

5. Method according to claim 1, wherein said annular collision surface describes a cylinder, the cylinder axis of which is coincident with said axis of rotation.

6. Method according to claim 1, wherein said collision member is provided on its inner periphery with an annular collision surface and does not have any projecting collision relief.

7. Method according to claim 1, wherein at least said annular collision surface is in the form of a truncated cone widening towards the bottom.

8. Method according to claim 1, wherein said annular collision surface describes a regular polygon edge, the centre of which polygon is coincident with said axis of rotation.

9. Method according to claim 8, wherein the central angle of said regular polygon is equal to or less than 36°.

10. Method according to claim 8, wherein said regular polygon edge is constituted by collision plates which are placed alongside one another and are provided with a flat annular collision surface.

11. Method according to claim 1, wherein said annular collision surface is at least, partially constituted by a bed of crushed material.

12. Method according to claim 11, wherein said bed of crushed material builds up in a channel-shaped construction that extends centrally around said rotor, which channel construction is open along the inside that faces towards said axis of rotation and is oriented transversely to said ejection stream.

13. Method according to claim 11, wherein said annular collision surface is constituted by a metal annular collision surface that is provided all round with openings which are located regular distances apart, in such a way that the material itself can settle in said openings, such that the impact of the material on the annular collision surface takes place partly on metal and partly on the material itself.

14. Method according to claim 11, wherein said annular collision member is constituted by collision plates which are positioned alongside one another regular distances apart, in such a way that the material itself is able to settle in the openings between said collision plates and the impacts on the annular collision surf ace take place partially on said collision plates and partially on the material itself.

15. Method according to claim 14, wherein the annular collision surface of said collision plates is straight.

16. Method according to claim 14, wherein said openings between said collision plates are formed in that intermediate collision plates are placed between the collision plates, which intermediate collision plates are provided with an intermediate collision surface that is a greater radial distance away from said axis of rotation than are the collision surfaces of said collision plates.

17. Method according to claim 1, wherein said rotor can be rotated in at least one direction.

18. Method according to claim 1, wherein:

said acceleration takes place with the aid of said accelerator unit that is carried by said rotor (222) and is located a radial distance away from said axis of rotation (O) that is greater than the corresponding radial distance to said metering location (221), and consists of at least one accelerator member (224), which accelerator unit (224) extends from a feed location (225) towards a take-off location (226) that is located a greater radial distance away from said axis of rotation (O) than is said feed location (225), saidmaterial at said feed location (225) being picked up by said accelerator unit (224) and accelerated with the aid of said accelerator unit (224), after which said accelerated material, when it leaves said accelerator unit (224) at said take-off location (226), is propelled outwards from said accelerator unit (224) at an absolute take-off velocity (Vabs) which is made up of a radial (Vr) and a transverse (Vt) velocity component, at an essentially predetermined take-off angle (α), along a straight ejection stream (227) that is oriented forwards, the magnitude of which take-off angle (α) is determined by the magnitudes of said radial (Vr) and transverse (Vt) velocity components, viewed in the direction of rotation (Ω) and viewed from a stationary standpoint;

said accelerated material extends along said straight ejection stream (227) in the apparent sense in an increasingly more radial direction as said material moves further away from said axis of rotation (O), which straight ejection stream (227) describes an apparent angle of movement (α") between the straight ejection line (227) that is determined by said straight ejection stream (227) and the radial line from said axis of rotation (228) that intersects this straight ejection stream (227) at a point of intersection (s") at a location along said straight ejection line (227), which apparent angle of movement (α") changes between said take-off location (226) and the stationary collision location (229) where said material impinges on said stationary collision member (230), and specifically from a first angle of movement (α') at the location where said point of intersection (s') is coincident with said take-off location (226) to a final apparent angle of movement (α'") at the location where said point of intersection (s'") is coincident with said collision location (229), said apparent angle of movement (α") being smaller than said first angle of movement (α'), greater than said final apparent angle of movement (α'") and becoming increasingly smaller as the radial intermediate distance (r") from said axis of rotation (O) to said point of intersection (s") increases compared with the radial distance (r1) from said axis of rotation (O) to the take-off location (226), viewed in the direction of rotation (Ω) and viewed from a stationary standpoint;

said material that moves along said ejection stream (227) collides in an essentially deterministic manner at an essentially predetermined stationary collision location (229) and at an essentially predetermined collision velocity (Vabs) with the aid of at least one stationary collision member (230) that is arranged around said rotor (222) a radial distance away from said axis of rotation (O) that is greater than the corresponding radial distance to said outer edge (223) of said rotor (222), which collision member (230) is provided along the inside with at least one annular collision surface (231) that is oriented essentially transversely to said straight ejection stream (227), said second radial distance (r2) from said axis of rotation (O) to said collision location (229) in relation to said corresponding first radial distance (r1), the ratio (r2/r1), being chosen at least sufficiently large that said material impinges on said annular collision surface (231) in an essentially deterministic manner at an essentially predetermined collision angle (β), which is sufficiently large that said material is sufficiently loaded during the collision—but at least equal to or greater than 600 and less than 90°—which ratio (r2/r1) is determined by the magnitude of said take-off angle (α), and which collision angle (β) is essentially determined by said final apparent angle of movement (α""), said material being guided, when it leaves said collision location (229), into a first straight movement path (232) that is oriented forwards, viewed in the plane of rotation, viewed in the direction of rotation (Ω), viewed from said axis of rotation (O) and viewed from a stationary standpoint, and is guided into a spiral movement path (233) that is oriented backwards, viewed from said axis of rotation (O) and viewed from a standpoint co-rotating with said accelerator unit (224).

19. Method according to claim 18, wherein said ratio between said second radial distance (r2) and said first radial distance (r1), the ratio (r2/r1), essentially complies with the equation:

$$\frac{r_2}{r_1} \quad \frac{\cos}{\cos \frac{}{180}}$$

r1=the first radial distance from said axis of rotation to said take-off location, r2=the second radial distance from said axis of rotation to said collision location, α=the take-off angle between the straight line having thereon said take-off location that is oriented perpendicularly to the radial line from said axis of rotation having thereon said take-off location and the straight line, from said take-off location, that is determined by the movement of said material along said straight stream, and β=the collision angle between the straight line having thereon said collision location that is oriented perpendicularly to the radial line from said axis of rotation having thereon said collision location and the straight line from said take-off location having thereon said collision location.

20. Method according to claim 1, wherein said collision angle (β) is greater than or equal to 60° and less than 85°.

21. Method according to claim 1, wherein said collision angle (β) is greater than or equal to 65° and less than 85%.

22. Method according to claim 1, wherein said collision angle (β) is greater than or equal to 70° and less than 85°.

23. Method according to claim 1, wherein said collision angle (β) is greater than or equal to 75° and less than 85°.

24. Method according to claim 1, wherein said collision angle (β) is greater than or equal to 80° and less than 85°.

25. Method according to claim 1, wherein the ratio (r2/r1) is equal to or greater than 1.75.

26. Method according to claim 1, wherein the ratio (r2/r1) is equal to or greater than 2.

27. Method according to claim 1, wherein said collision angle (β) is essentially not affected by the wear which occurs along said annular collision surface.

28. Method according to claim 1, comprising:

causing said material that is moving along said spiral movement path to impinge in an essentially deterministic manner on an impingement location, with the aid of a moving impingement member that is carried by said rotor and is located a greater radial distance away from said axis of rotation than is said accelerator unit, a smaller radial distance away from said axis of rotation than is said stationary collision member and behind the radial line from said axis of rotation with said, stationary collision location thereon, which impingement member is provided with an impingement surface that is oriented essentially transversely to said spiral movement path, viewed at the point in time when said material collides, viewed in the plane of rotation, viewed in the direction of rotation, viewed from said axis of rotation and viewed from a standpoint co-rotating with said impingement member, after which said material, when it leaves said impingement member, is guided into a second straight movement path that is oriented forwards, viewed in the plane of rotation, viewed in the direction of rotation and viewed from a stationary standpoint.

29. Method according to claim 1, comprising:

causing said material, that is moving along said straight movement path, to be entrained by a vortex stream which is generated by the rotary movement of said rotor, which vortex stream describes, from said collision member, a spiral movement that is oriented downwards along the surface of an autogenous bed of crushed material that builds up in a collection chamber beneath said stationary collision member, which autogenous surface is in the form of a truncated cone narrowing towards the bottom, said material describing, when it is entrained by said vortex stream, a corrasive movement along said autogenous surface in order to render said material cubic, after which said material that has been rendered cubic is guided, when it leaves said autogenous bed, through a discharge opening.

30. Method according to claim 1, for causing a stream of granular material to collide once in an essentially deterministic manner, with the aid of at least one stationary collision member, said accelerator unit being constituted by:

an accelerator member in the form of an acceleration member that is provided with an acceleration surface that extends from said feed location towards said take-off location, with the aid of which acceleration member said material is accelerated under the influence of centrifugal force by movement of said material along said acceleration surface between said feed location where said material is fed to said acceleration surface and said take-off location where said material leaves said acceleration surface;

said material being accelerated in one step with the aid of said acceleration unit, that is to say movements along said acceleration surface.

31. Method according to claim 30, wherein said ejection location is coincident with said outer edge of said acceleration surface.

32. Method according to claim 1, for causing said material directly to collide twice in an essentially deterministic manner, wherein said accelerator unit is constituted by:

a first accelerator member in the form of a guide member that is provided with a guide surface that extends from said feed location towards a dispensing location that is located a greater radial distance away from said axis of rotation than is said feed location and a smaller radial distance away from said axis of rotation than is said take-off location, with the aid of which guide member said material is guided under the influence of centrifugal force by movement of said material along said guide surface between said feed location where said material is fed to said guide surface and said dispensing location where said material leaves said guide surface, said material being guided outwards, when it leaves said first accelerator member at said dispensing location, in a first spiral intermediate stream that is oriented backwards, viewed in the direction of rotation, viewed from said axis of rotation and viewed from a standpoint co-rotating with said first accelerator member;

a second accelerator member in the form of an impact member that is associated with said guide member and is located at a location a greater radial distance away from said axis of rotation than is said dispensing location and behind the radial line from said axis of rotation with said dispensing location thereon, which impact member is provided with at least one impact surface that is oriented essentially transversely to said first spiral intermediate stream in such a way that said material impinges on said impact surface in an essentially deterministic manner, at an essentially predetermined impact velocity, at an essentially predetermined impact location and at an essentially predetermined impact angle (δ), viewed in the direction of rotation, viewed from said axis of rotation and viewed from a standpoint co-rotating with said second accelerator member, after which said material leaves said impact surface at said take-off location;

said material being accelerated with the aid of said accelerator unit in two steps, respectively by guiding along said guide member, followed by striking against said impact member.

33. Method according to claim 32, wherein said take-off location is located at an essentially predetermined location between said impact location and said outer edge of said impact surface.

34. Method according to claim 32, wherein said ejection location is coincident with said outer edge of said impact surface.

35. Method according to claim 1, for causing said material to collide directly several times in an essentially deterministic manner, wherein said accelerator unit is constituted by:

a first accelerator member in the form of a guide member that is provided with a guide surface that extends from said feed location towards a first dispensing location that is located a greater radial distance away from said axis of rotation than is said feed location and a smaller radial distance away from said axis of rotation than is said take-off location, with the aid of which guide member said material is guided under the influence of centrifugal force by movement of said material along said guide surface between said feed location where said material is fed to said guide surface and said first dispensing location where said material leaves said guide surface, said material being guided outwards, when it leaves said, first accelerator member at said first dispensing location, in a first spiral intermediate stream that is oriented backwards, viewed in the direction of rotation, viewed from said axis of rotation and viewed from a standpoint co-rotating with said first accelerator member;

a second accelerator member in the form of a first impact member that is associated with said guide member and is located at a location a greater radial distance away from said axis of rotation than is said first dispensing location, a smaller radial distance away from said axis of rotation than said take-off location and behind the radial line from said axis of rotation with said first dispensing location thereon, which impact member is provided with at least one first impact surface that is oriented essentially transversely to said first spiral intermediate stream in such a way that said material impinges on said first impact surface in an essentially deterministic manner, at an essentially predetermined first impact velocity, at an essentially predetermined first impact location and at an essentially predetermined first impact angle (δ1), said material being guided outwards, when it leaves said second accelerator member at a second dispensing location, in a second spiral intermediate stream that is oriented backwards, viewed in the direction of rotation, viewed from said axis of rotation and viewed from a standpoint co-rotating with said second accelerator member;

a third accelerator member in the form of a second impact member associated with said first impact member, which second impact member, is located at a location a greater radial distance away from said axis of rotation than is said second dispensing location and behind the radial line from said axis of rotation with said second dispensing location thereon and is provided with at least one second impact surface that is oriented essentially transversely to said second spiral intermediate stream in such a way that said material impinges on said second impact surface in an essentially deterministic manner, at an essentially predetermined second impact velocity, at an essentially predetermined second impact location and at an essentially predetermined second impact angle (δ2), after which said material leaves said second impact surface at said take-off location;

said material being accelerated in three steps, respectively by guiding along said guide member, followed by a first strike against said first impact member and a second strike against said second impact member.

36. Method according to claim 35, wherein said take-off location is located at an essentially predetermined location between said second impact location and said outer edge of said second impact surface.

37. Method according to claim 35, wherein said ejection location is coincident with said outer edge of said second impact surface.

* * * * *

UNITED STATES PATENT AND TRADEMARK OFFICE

CERTIFICATE OF CORRECTION

PATENT NO. : 6,974,096 B2 
DATED : December 13, 2005
INVENTOR(S) : Johannes Petrus Andreas Josephus Van Der Zanden It is certified that error appears in the above-identified patent and that said Letters Patent is hereby corrected as shown below:

Title page,
Insert Item:
-- [30] Foreign Application Priority Data
July 2, 2000 (NL).....1015583
October 12, 2000 (NL).....1016393 --.

Signed and Sealed this

Fourteenth Day of March, 2006

JON W. DUDAS
*Director of the United States Patent and Trademark Office*